US011256212B2

(12) United States Patent
Matsuoka et al.

(10) Patent No.: US 11,256,212 B2
(45) Date of Patent: Feb. 22, 2022

(54) PAPER FEEDING DEVICE AND IMAGE PROCESSING APPARATUS

(71) Applicants: Kabushiki Kaisha Toshiba, Tokyo (JP); Toshiba Tec Kabushiki Kaisha, Tokyo (JP)

(72) Inventors: Kei Matsuoka, Kawasaki Kanagawa (JP); Takamitsu Sunaoshi, Yokohama Kanagawa (JP); Shunsuke Hattori, Kawasaki Kanagawa (JP); Masahiro Ohno, Mishima Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/818,439

(22) Filed: Mar. 13, 2020

(65) Prior Publication Data

US 2020/0310348 A1 Oct. 1, 2020

(30) Foreign Application Priority Data

Apr. 1, 2019 (JP) ..... JP2019-069995

(51) Int. Cl.
*G03G 21/20* (2006.01)
*B65H 1/04* (2006.01)
(Continued)

(52) U.S. Cl.
CPC ..... *G03G 21/206* (2013.01); *B65H 1/04* (2013.01); *B65H 3/14* (2013.01); *G03G 15/6502* (2013.01)

(58) Field of Classification Search
CPC ..... G03G 15/6502; G03G 15/6511; G03G 2215/004; G03G 2215/00383; G03G 2215/00396; G03G 2221/1645; G03G 21/206; B65H 1/04; B65H 3/08; B65H 3/14
See application file for complete search history.

(56) References Cited

U.S. PATENT DOCUMENTS 6,015,144 A 1/2000 Yoshii et al.
7,823,876 B2 11/2010 Okumura et al.
(Continued)

FOREIGN PATENT DOCUMENTS

EP 3470353 A1 4/2019
JP H01-38096 Y2 11/1989
(Continued)

*Primary Examiner* — Thomas S Giampaolo, II
(74) *Attorney, Agent, or Firm* — Kim & Stewart LLP

(57) ABSTRACT

A paper feeding device of an embodiment includes a paper feed cassette, an alignment component, a fan, and a fan guiding duct component. A paper bundle in which a plurality of sheets of paper are stacked can be placed on the paper feed cassette. The alignment component can align the paper bundle placed on the paper feed cassette. The fan is connected to the alignment component. The fan can generate airflow. The fan guiding duct component is connected to the alignment component. The fan guiding duct component is positioned above the paper bundle placed on the paper feed cassette. The fan guiding duct component generates a negative pressure between the fan guiding duct component and an uppermost sheet of paper in the paper bundle due to the airflow from the fan.

19 Claims, 12 Drawing Sheets

(51) Int. Cl.
*B65H 3/14* (2006.01)
*G03G 15/00* (2006.01)

(56) References Cited

U.S. PATENT DOCUMENTS

| | | | | |
|---|---|---|---|---|
| 2005/0063023 | A1 | 3/2005 | Komatsu et al. | |
| 2007/0045933 | A1 | 3/2007 | Okazaki | |
| 2008/0297580 | A1* | 12/2008 | Fukumoto ..... | B65H 3/60<br>347/104 |
| 2010/0025919 | A1* | 2/2010 | Okumura ..... | B65H 3/48<br>271/12 |
| 2019/0106284 | A1 | 4/2019 | Matsuoka et al. | |

FOREIGN PATENT DOCUMENTS

| | | | |
|---|---|---|---|
| JP | 2005-112560 | A | 4/2005 |
| JP | 2006-321629 | A | 11/2006 |
| JP | 2007-55786 | A | 3/2007 |
| JP | 4154299 | B2 | 9/2008 |
| JP | 2010-58917 | A | 3/2010 |
| JP | 4544033 | B2 | 9/2010 |
| JP | 2019-69847 | A | 5/2019 |

* cited by examiner

PAPER FEEDING DEVICE AND IMAGE PROCESSING APPARATUS

CROSS-REFERENCE TO RELATED APPLICATION

This application claims priority from Japanese Patent Application No. 2019-069995 filed on Apr. 1, 2019, the contents of which are incorporated herein by reference in their entirety.

FIELD

Embodiments described herein relate generally to a paper feeding device and an image processing apparatus.

BACKGROUND

A paper feeding device includes a paper feed cassette. A paper bundle in which a plurality of sheets of paper are stacked can be placed on the paper feed cassette. For example, a pickup roller may be in contact with an upper surface of the paper bundle placed on the paper feed cassette. When the pickup roller rotates, paper is fed out of the paper feed cassette.

Incidentally, in a paper feeding device, it is required to convey one sheet of paper at a time from a paper bundle placed on a paper feed cassette. In order to avoid sending out paper with a plurality of sheets of paper overlapped (multi-feed), paper positioned uppermost (hereinafter referred to as an "uppermost sheet of paper") in the paper bundle placed on the paper feed cassette needs to be separated from the paper bundle.

DETAILED DESCRIPTION

A paper feeding device of an embodiment includes a paper feed cassette, an alignment component, a fan, and a fan guiding duct component. A paper bundle in which a plurality of sheets of paper are stacked can be placed on the paper feed cassette. The alignment component can align the paper bundle placed on the paper feed cassette. The fan is connected to the alignment component. The fan can generate airflow. The fan guiding duct component is connected to the alignment component. The fan guiding duct component is positioned above the paper bundle placed on the paper feed cassette. The fan guiding duct component generates a negative pressure between the fan guiding duct component and an uppermost sheet of paper in the paper bundle due to the airflow from the fan.

Hereinafter, a paper feeding device of an embodiment will be described with reference to the drawings. In each of the drawings, the same components are denoted by the same references.

The paper feeding device will be described.

Figure 1:
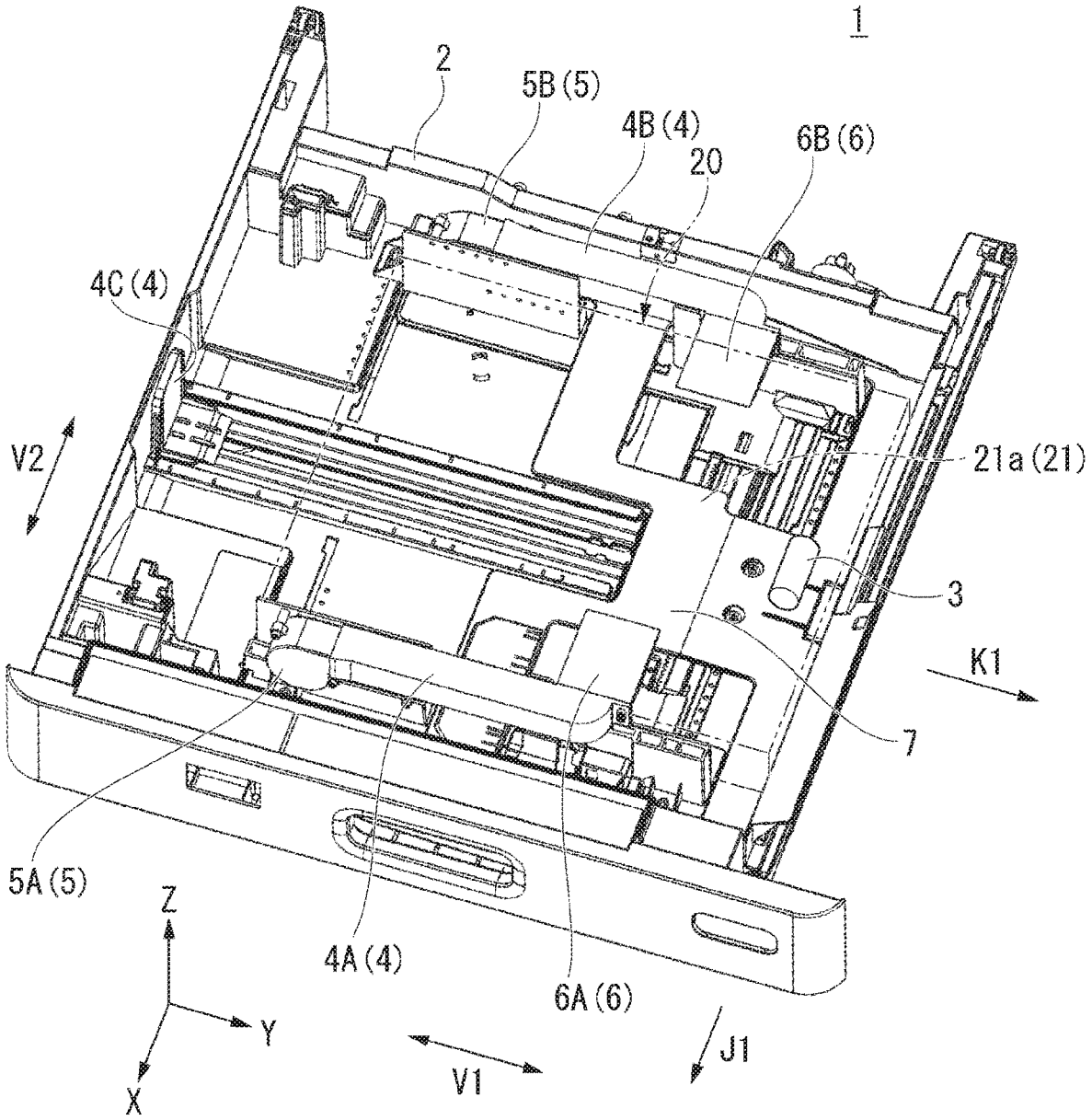
FIG. 1 is a perspective view illustrating a paper feeding device of an embodiment.
Figure 2:
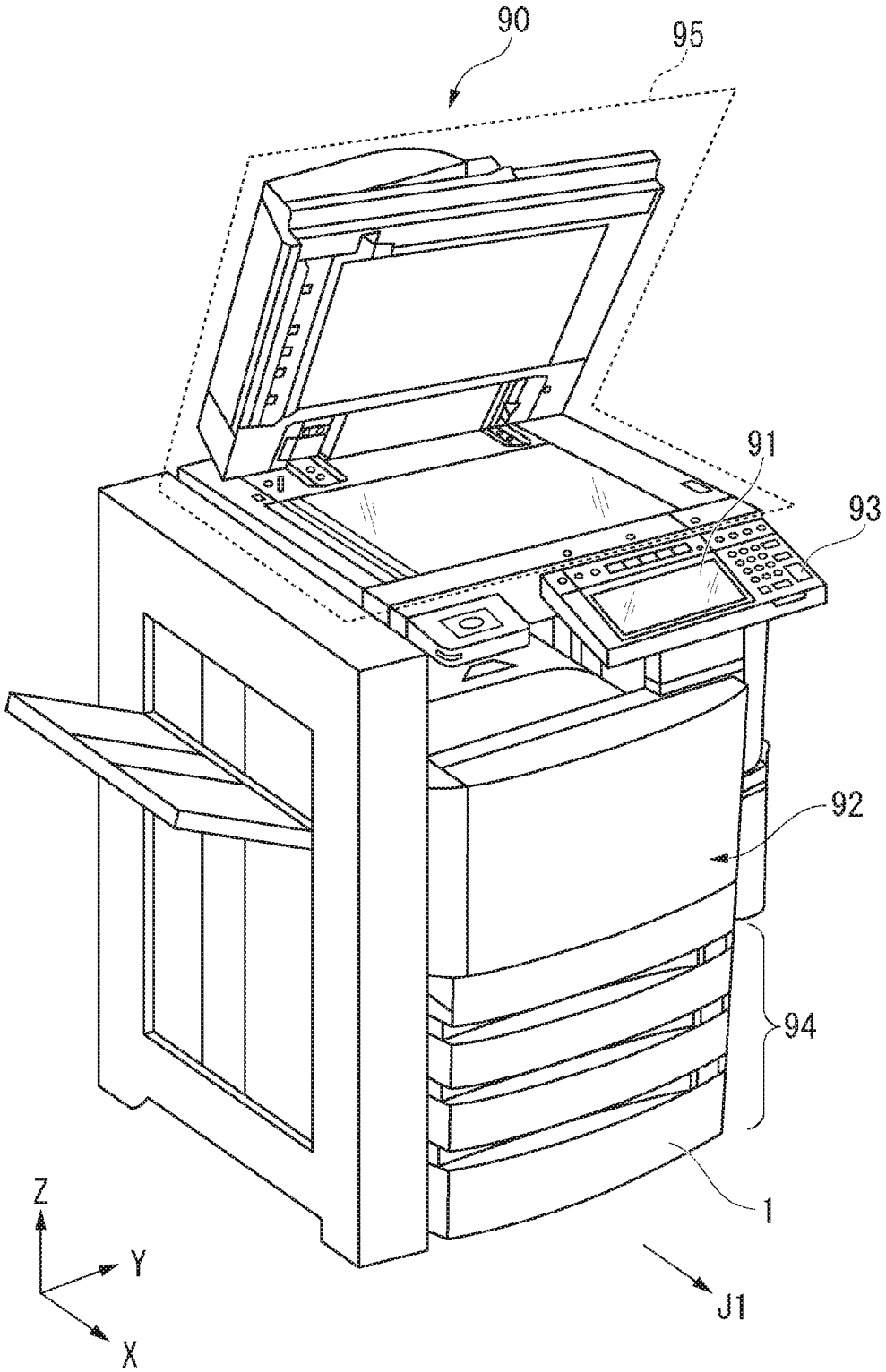
FIG. 2 is a perspective view illustrating an image forming device in which the paper feeding device of the embodiment is mounted.

FIG. 1 is a perspective view illustrating a paper feeding device 1 of the embodiment. FIG. 2 is a perspective view illustrating an image forming device 90 in which the paper feeding device 1 of the embodiment is mounted. The following description will use an X, Y, Z orthogonal coordinate system as necessary. A predetermined direction in a horizontal plane is referred to as an X direction, a direction perpendicular to the X direction in the horizontal plane is referred to as a Y direction, and a direction perpendicular to both the X and Y directions (that is, a vertical direction) is referred to as a Z direction. In the X direction, the Y direction, and the Z direction, an arrow direction in the drawing is referred to as a positive (+) direction, and a direction opposite to the arrow is referred to as a negative (−) direction. The +X direction is forward, the −X direction is rearward, the +Y direction is right, the −Y direction is left, the +Z direction is upward, and the −Z direction is downward.

As illustrated in FIG. 1, the paper feeding device 1 includes a paper feed cassette 2, a pickup roller 3, an alignment component 4, a fan 5, a fan guiding duct component 6, a tilting tray 7, a paper position detection unit 8 (see FIG. 7), a tilt angle varying mechanism 9 (see FIG. 8), a sensor 10 (see FIG. 7), and a system control unit 50. For example, the paper feeding device 1 may be mounted in the image forming device 90 (see FIG. 2) such as a printer.

The image forming device 90 will be described.

The image forming device 90 may be, for example, a multi-function printer (MFP). For example, the image forming device 90 forms an image on paper using a developer such as toner. For example, paper or label paper may be included in the paper. The paper may be anything as long as an image can be formed on its surface. In the example of FIG. 2, the image forming device 90 includes a display 91, a printing unit 92, a control panel unit 93, a paper accommodating unit 94, and an image reading unit 95. The paper accommodating unit 94 includes a multi-level paper feed cassette aligned in a vertical direction (Z direction). For example, the paper feeding device 1 of the embodiment may be disposed at a lowermost level of the paper accommodating unit 94.

The paper feed cassette 2 will be described.

As illustrated in FIG. 1, a paper bundle 20 in which a plurality of sheets of paper are stacked can be placed on the paper feed cassette 2. The paper is a sheet-shaped recording medium. The paper feed cassette 2 supports the paper bundle 20 from below. The paper feed cassette 2 surrounds the paper bundle 20. The paper feed cassette 2 has a box shape which opens upward. The paper feed cassette 2 has an outer shape corresponding to a plurality of paper sizes.

The paper feed cassette 2 has a longitudinal dimension in a paper conveying direction K1 (hereinafter referred to as a "paper conveying direction K1"). The paper feed cassette 2 feeds unused paper using the pickup roller 3. The paper feed cassette 2 can be taken out from the image forming device 90 in a direction of arrow J1 (see FIG. 2).

In the drawings, an arrow V1 indicates a direction parallel to the paper conveying direction K1 (hereinafter also referred to as a "first direction V1"), and an arrow V2 indicates a direction (hereinafter also referred to as a "second direction V2") parallel to a width direction of the paper (hereinafter referred to as a "paper width direction") perpendicular to the paper conveying direction K1 and parallel to an upper surface 21*a* of the paper.

The pickup roller 3 will be described.

As illustrated in FIG. 1, the pickup roller 3 takes out paper from the paper feed cassette 2. The pickup roller 3 is positioned on a downstream side in the paper conveying direction K1 of an upper portion of the paper bundle 20 placed on the paper feed cassette 2. The pickup roller 3 is in contact with the upper surface 21*a* of the paper bundle 20 placed on the paper feed cassette 2. The pickup roller 3 is connected to a drive mechanism (not illustrated) including a motor or the like. When the pickup roller 3 is rotated by an operation of the drive mechanism, paper is fed out of the paper feed cassette 2.

The alignment component 4 will be described.

As illustrated in FIG. 1, a plurality of alignment components 4 are provided. The plurality of alignment components 4 include a pair of lateral alignment components 4 disposed at a distance from each other in the paper width direction. The pair of lateral alignment components 4 extend in the first direction V1. The pair of lateral alignment components 4 position the paper bundle 20 in the paper width direction by being in contact with the paper bundle 20 from an outward side in the paper width direction. Hereinafter, of the pair of lateral alignment components 4, one positioned on a front side (+X direction) of the paper bundle 20 is also referred to as a "front alignment component 4A," and one positioned on a rear side (−X direction) of the paper bundle 20 is also referred to as a "rear alignment component 4B."

Figure 4:
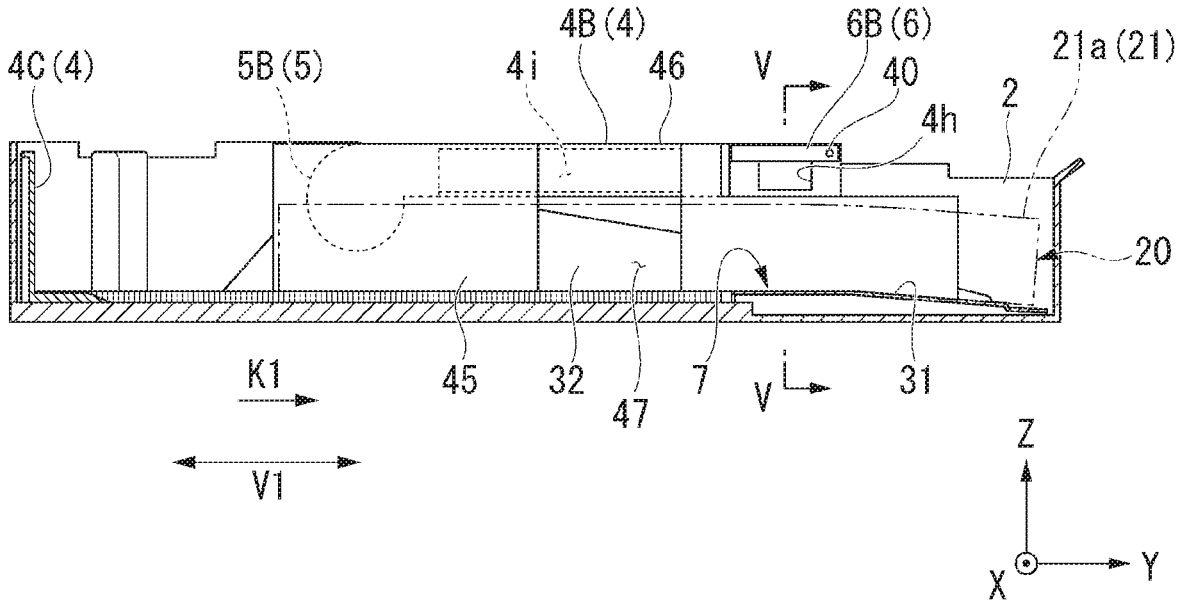
FIG. 4 is a view including a cross section taken along line IV-IV of FIG. 3.

The front alignment component 4A can be in contact with the paper bundle 20 from the front of the paper bundle 20. The rear alignment component 4B can be in contact with the paper bundle 20 from the rear of the paper bundle 20. The alignment components 4 each include an air blowout port 4*h* (see FIG. 4) which opens so that airflow from the fan 5 flows toward a space between the upper surface 21*a* of an uppermost sheet of paper 21 and a lower surface of the fan guiding duct component 6. When viewed from the front, the air blowout port 4*h* has a rectangular shape (see FIG. 4) extending in the first direction. In the drawing, reference 45 denotes a lateral alignment plate constituting the lateral alignment component 4, reference 46 denotes a duct connected to the lateral alignment plate 45, and reference 47 denotes a tray relief part for avoiding the tilting tray 7.

The plurality of alignment components 4 further include a longitudinal alignment component 4C disposed at an upstream position (−Y direction) of the paper bundle 20 in the paper conveying direction K1. The longitudinal alignment component 4C positions the paper bundle 20 in the paper conveying direction K1 by being in contact with the paper bundle 20 from an outward side in the paper conveying direction K1. The longitudinal alignment component 4C functions as a left alignment component that can be in contact with the paper bundle 20 from the left side of the paper bundle 20.

The fan 5 will be described.

Figure 3:
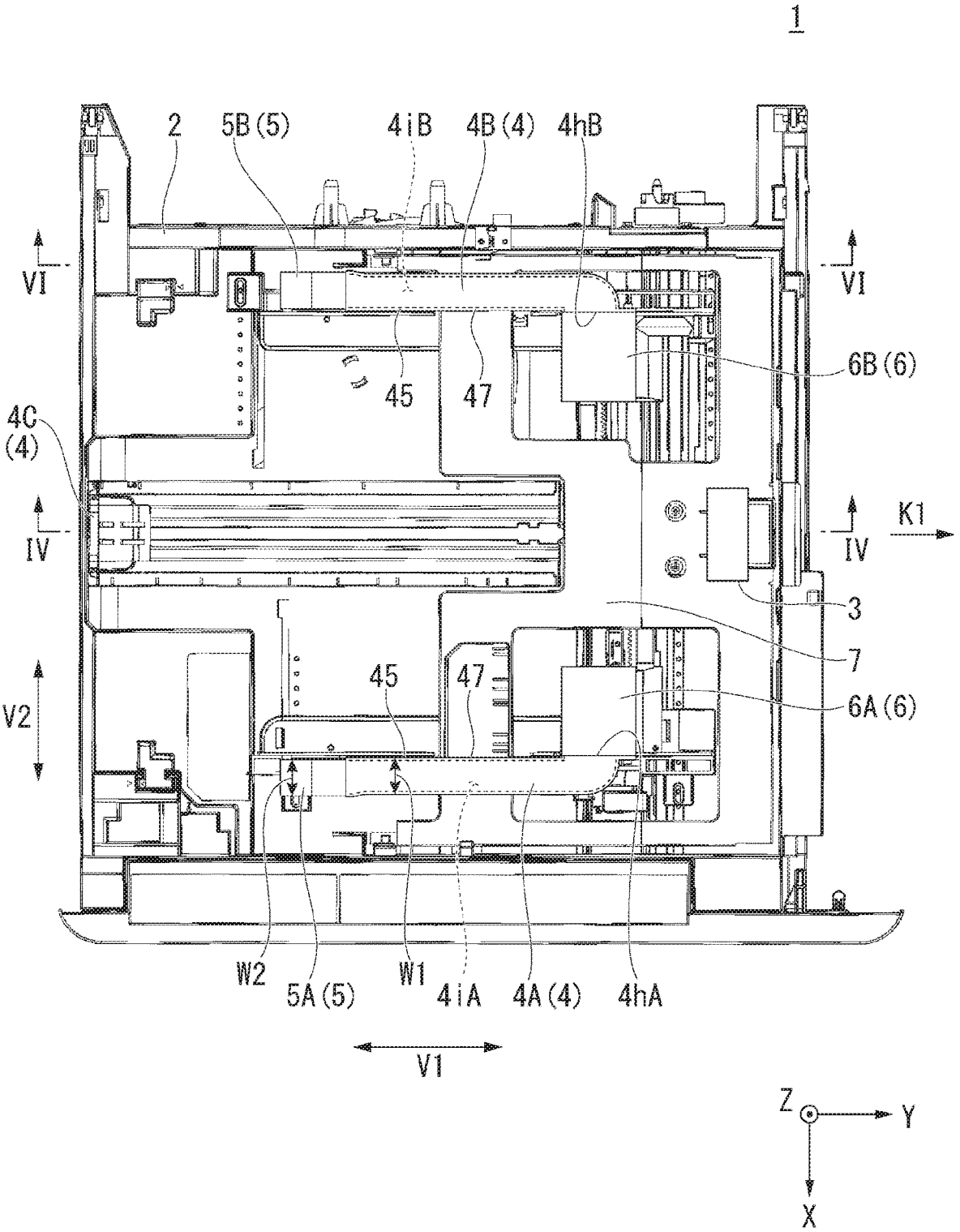
FIG. 3 is a top view illustrating the paper feeding device of the embodiment.

As illustrated in FIG. 1, the fan 5 is connected to the alignment component 4. The fan 5 can generate airflow. In the embodiment, a plurality of fans 5 are provided. The plurality of fans 5 are respectively connected to the pair of lateral alignment components 4 (the front alignment component 4A and the rear alignment component 4B). Each of the fans 5 is fixed to a left end of each of the lateral alignment components 4. In a left side view, the fan 5 overlaps the lateral alignment component 4. In FIG. 3, reference W1 denotes a length of the lateral alignment component 4 in the paper width direction (hereinafter also referred to as a "width of the lateral alignment component 4"), and reference W2 denotes a length of the fan 5 in the paper width direction (hereinafter also referred to as a "width of the fan 5"). The width W2 of the fan 5 is substantially the same as the width W1 of the lateral alignment component 4 (W2≈W1).

Hereinafter, the fan 5 connected to the front alignment component 4A is also referred to as a "first fan 5A," and the fan 5 connected to the rear alignment component 4B is also referred to as a "second fan 5B."

A flow of airflow from each fan 5 will be described.

Reference 4*i*A in FIG. 3 indicates an airflow passage for guiding airflow from the first fan 5A (hereinafter also referred to as a "first airflow passage"). The first airflow passage 4*i*A is provided inside the front alignment component 4A. An internal space of the front alignment component 4A functions as the first airflow passage 4*i*A. An air blowout port 4*h*A (hereinafter also referred to as a "first air blowout port 4*h*A") that opens so that airflow from the first airflow passage 4*i*A goes out toward the upper surface 21*a* of the uppermost sheet of paper 21 (see FIG. 1) is provided on an inner surface (rear surface) at a right end portion of the front alignment component 4A. The front alignment component 4A functions also as a duct (first duct) which guides airflow generated by the first fan 5A through the first airflow passage 4*i*A and then from the first air blowout port 4*h*A toward the upper surface 21*a* of the uppermost sheet of paper 21 (see FIG. 1).

Reference 4*i*B in FIG. 3 indicates an airflow passage for guiding airflow from the second fan 5B (hereinafter, also referred to as a "second airflow passage"). The second airflow passage 4*i*B is provided inside the rear alignment component 4B. An internal space of the rear alignment component 4B functions as the second airflow passage 4*i*B. An air blowout port 4*h*B (hereinafter also referred to as a "second air blowout port 4*h*B") that opens so that airflow from the second airflow passage 4*i*B goes out toward the upper surface 21*a* of the uppermost sheet of paper 21 (see FIG. 1) is provided on an inner surface (front surface) at a right end portion of the rear alignment component 4B. The rear alignment component 4B functions also as a duct (second duct) which guides airflow generated by the second fan 5B through the second airflow passage 4*i*B and then from the second air blowout port 4*h*B toward the upper surface 21*a* of the uppermost sheet of paper 21 (see FIG. 1).

The fan guiding duct component 6 will be described.

As illustrated in FIG. 1, the fan guiding duct component 6 is connected to the alignment component 4. The fan guiding duct component 6 is positioned above the paper bundle 20 placed on the paper feed cassette 2. The fan guiding duct component 6 generates a negative pressure between the fan guiding duct component 6 and the uppermost sheet of paper 21 of the paper bundle 20 due to the airflow from the fan 5. In the embodiment, a plurality of fan guiding duct components 6 are disposed above the paper bundle 20 placed on the paper feed cassette 2. The plurality of fan guiding duct components 6 include lateral fan guiding duct components 6A and 6B connected to the pair of lateral alignment components 4 (the front alignment component 4A and the rear alignment component 4B). Hereinafter, of the pair of lateral fan guiding duct components 6A and 6B, one connected to the front alignment component 4A is also referred to as a "first fan guiding duct component 6A," and one connected to the rear alignment component 4B is also referred to as a "second fan guiding duct component 6B."

The first fan guiding duct component 6A is positioned on the first fan 5A side. The first fan guiding duct component 6A generates a negative pressure between the first fan guiding duct component 6A and the uppermost sheet of paper 21 due to the airflow from the first fan 5A.

The second fan guiding duct component 6B is positioned on the second fan 5B side. The second fan guiding duct component 6B generates a negative pressure between the second fan guiding duct component 6B and the uppermost sheet of paper 21 due to the airflow from the second fan 5B.

The fan guiding duct component 6 has an airfoil shape. For example, the fan guiding duct component 6 may have a shape of a wing (main wing) of an airplane inverted upside down. The fan guiding duct component 6 has a continuous airfoil shape with no gaps. As illustrated in FIG. 1, the fan guiding duct component 6 has a fixed length in a direction (hereinafter, also referred to as a "first direction V1") parallel to the paper conveying direction K1. The fan guiding duct component 6 extends in a direction parallel to the upper surface 21*a* of the uppermost sheet of paper 21. The fan guiding duct component 6 continuously extends in the first direction V1.

Figure 5:
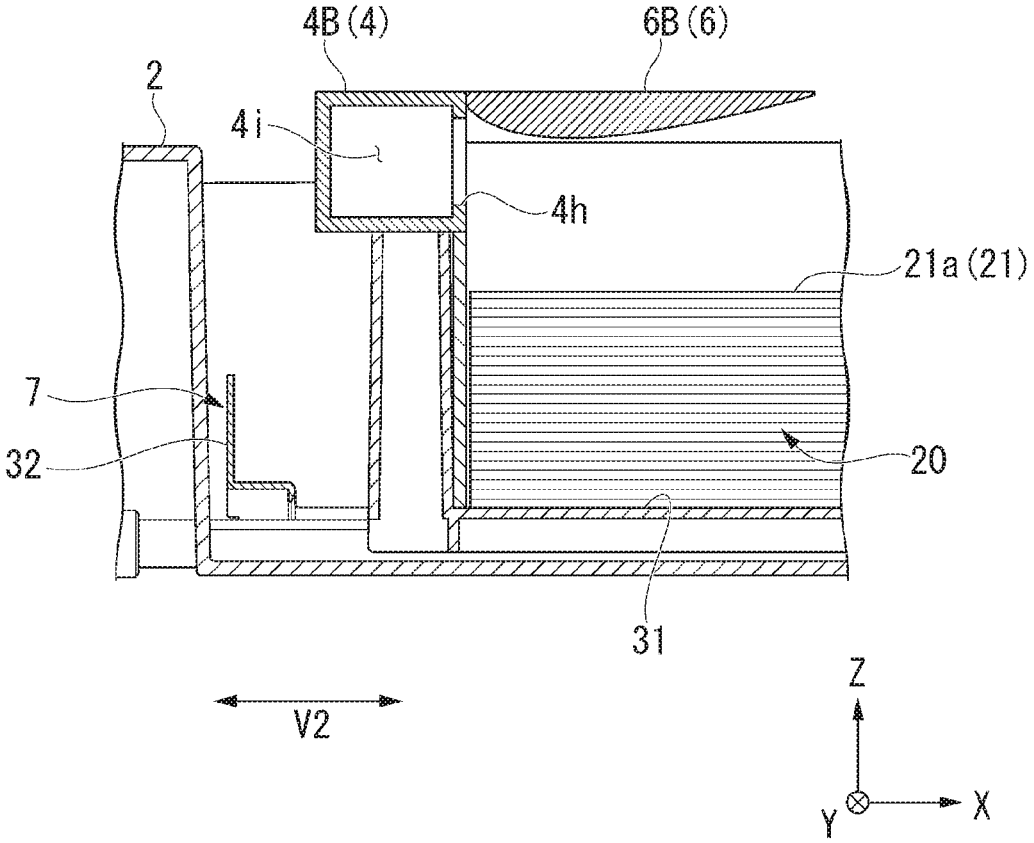
FIG. 5 is a view including a cross section taken along line V-V of FIG. 4.

FIG. 5 is a view illustrating the fan guiding duct component 6 of the embodiment together with the paper bundle 20. FIG. 5 is a view including a cross section taken along line V-V of FIG. 4. In the example of FIG. 5, the second fan guiding duct component 6B is illustrated.

As illustrated in FIG. 5, the fan guiding duct component 6 is disposed to be spaced apart from the uppermost sheet of paper 21 of the paper bundle 20. A lower portion of the fan guiding duct component 6 faces the upper surface 21*a* of the uppermost sheet of paper 21. In a cross-sectional view, an upper surface of the fan guiding duct component 6 has a substantially horizontal linear shape. In the cross-sectional view, the lower surface of the fan guiding duct component 6 is curved to be convex downward.

The tilting tray 7 will be described.

Figure 6:
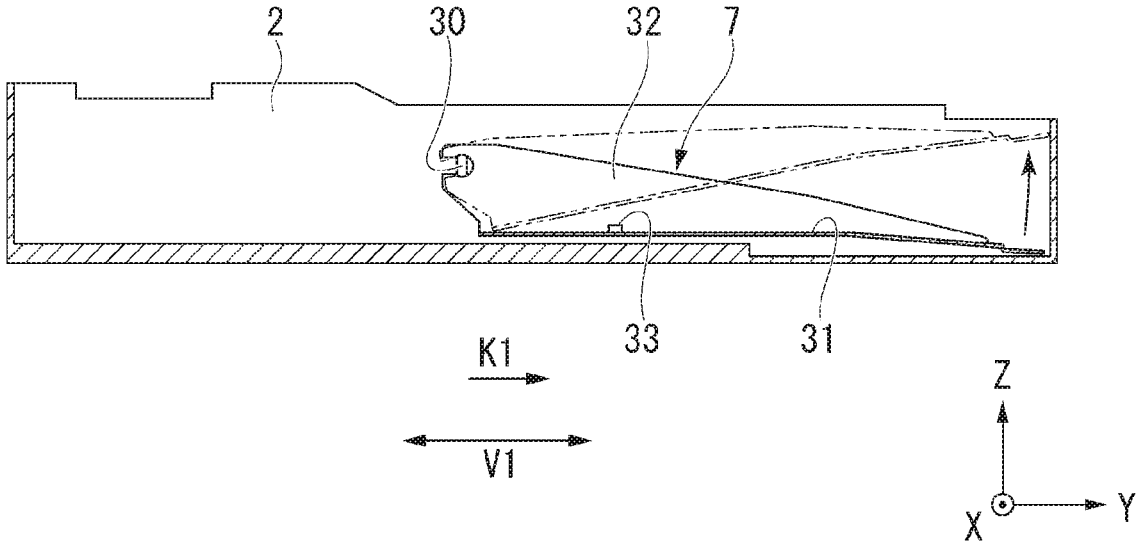
FIG. 6 is a view including a cross section taken along line VI-VI of FIG. 3.

FIG. 6 is a view including a cross section taken along line VI-VI of FIG. 3.

As illustrated in FIG. 6, the tilting tray 7 is provided to be tiltable in the paper feed cassette 2. The tilting tray 7 can tilt the paper bundle 20 so that an upstream end of the uppermost sheet of paper 21 in the paper conveying direction K1 is positioned as a lower part, and a downstream end of the uppermost sheet of paper 21 in the paper conveying direction K1 is positioned as an upper part (see FIG. 8).

In FIG. 6, a state of the tilting tray 7 before tilting is indicated by a solid line, a state of the tilting tray 7 after tilting is indicated by a two-dot dashed line, reference 30 denotes a tilting shaft which supports the tilting tray 7 to be tiltable, reference 31 denotes a tray main body on which the paper bundle 20 can be placed, and reference 32 denotes a connecting wall connecting the tray main body 31 and the tilting shaft 30. For example, the tilting shaft 30 may be provided on each of a front wall and a rear wall of the paper feed cassette 2.

As illustrated in FIG. 6, a tray-side sensor 33 capable of detecting a weight of the paper bundle 20 is provided on the tilting tray 7. For example, the tray-side sensor 33 may be provided on a loading surface of the paper bundle 20 on the tilting tray 7. For example, the tray-side sensor 33 may be an electronic balance. A detection result of the tray-side sensor 33 is sent to the system control unit 50 (see FIG. 7). Further, the tray-side sensor 33 is not limited to an electronic balance and may be other sensors such as a tilt sensor or an infrared position sensor.

The paper position detection unit 8 (see FIG. 7) will be described.

The paper position detection unit 8 can detect a position of the uppermost sheet of paper 21. A plurality of paper position detection units 8 are provided. For example, the plurality of paper position detection units 8 may be provided in each of the paper feed cassette 2 and the fan guiding duct component 6 (see FIG. 1). Hereinafter, the paper position detection unit 8 provided in the paper feed cassette 2 is also referred to as a "cassette-side paper position detection unit 8A," and the paper position detection unit 8 provided in the fan guiding duct component 6 is also referred to as an "airfoil-side paper position detection unit 8B" (see FIG. 7).

The cassette-side paper position detection unit 8A will be described.

For example, the cassette-side paper position detection unit 8A may be provided on a right wall of the paper feed cassette 2. For example, the cassette-side paper position detection unit 8A is a non-contact type displacement sensor such as a camera and an infrared sensor. A detection result of the cassette-side paper position detection unit 8A is sent to the system control unit 50.

The airfoil-side paper position detection unit 8B will be described.

Figure 7:
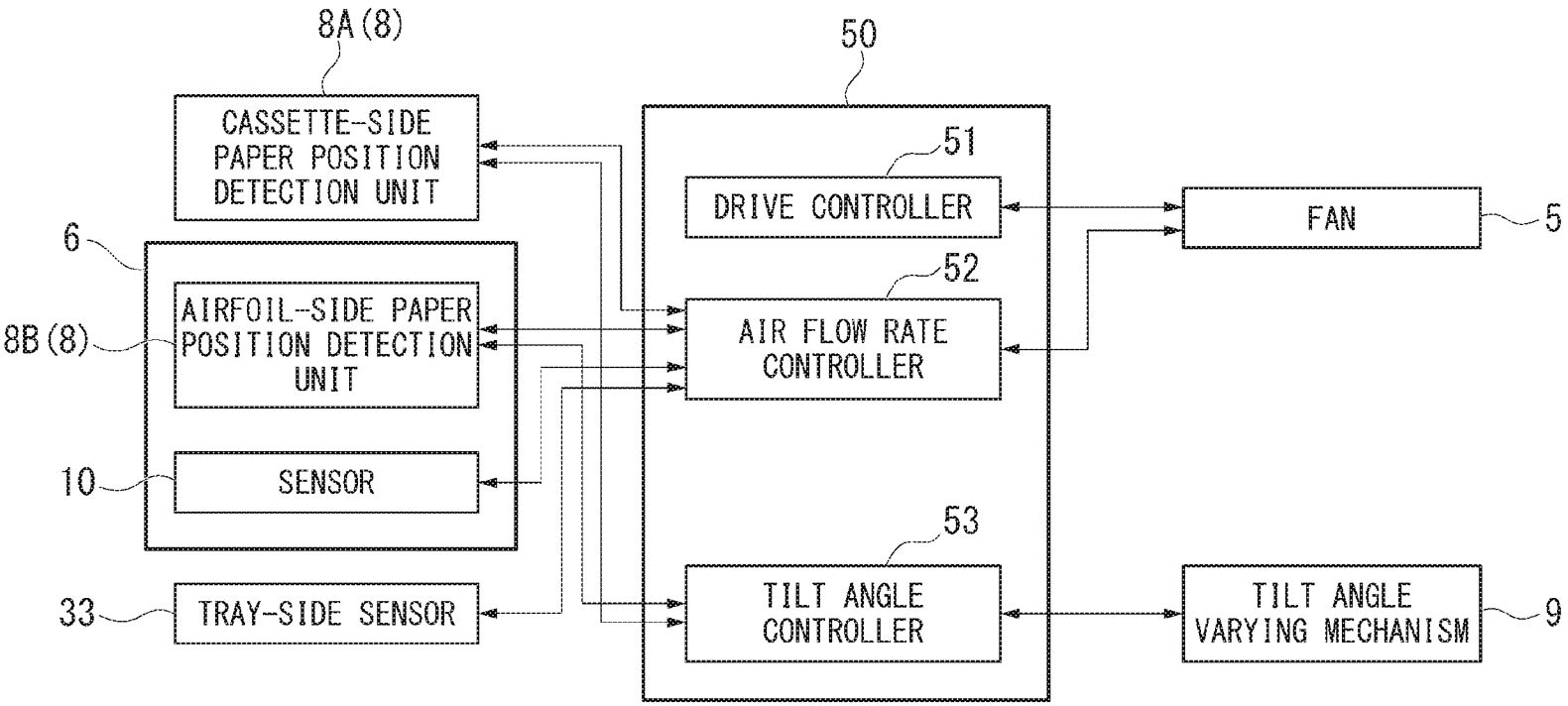
FIG. 7 is a block diagram illustrating a configuration of the paper feeding device of the embodiment.

As illustrated in FIG. 7, the airfoil-side paper position detection unit 8B is incorporated in the fan guiding duct component 6. For example, the airfoil-side paper position detection unit 8B may be provided in each of the first fan guiding duct component 6A and the second fan guiding duct component 6B. For example, the airfoil-side paper position detection unit 8B is a non-contact type displacement sensor such as a camera and an infrared sensor. The airfoil-side paper position detection unit 8B detects a position of the uppermost sheet of paper 21 from a lower surface side of the fan guiding duct component 6. A detection result of the airfoil-side paper position detection unit 8B is sent to the system control unit 50.

The tilt angle varying mechanism 9 will be described.

Figure 8:
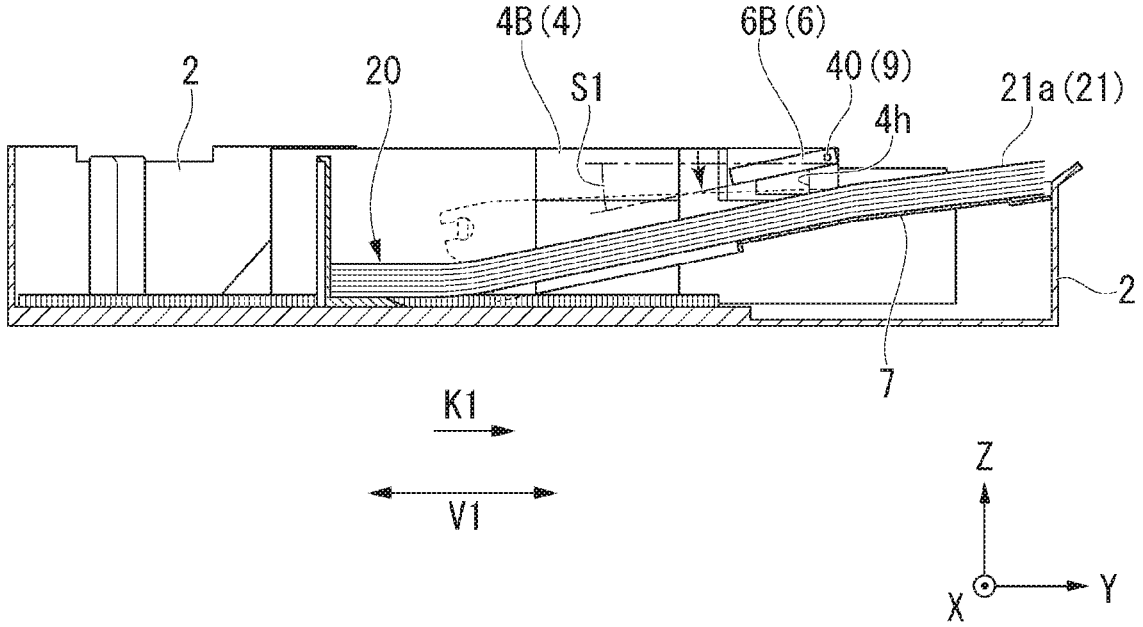
FIG. 8 is an explanatory view of an operation due to tilting of a fan guiding duct component of the embodiment.

As illustrated in FIG. 8, the tilt angle varying mechanism 9 can change a tilt angle S1 of the fan guiding duct component 6 so that an upstream end of the fan guiding duct component 6 in the paper conveying direction K1 is positioned as a lower part, and a downstream end of the fan guiding duct component 6 in the paper conveying direction K1 is positioned as an upper part.

In FIG. 8, a state of the fan guiding duct component 6 after tilting is indicated by a solid line, a state of the fan guiding duct component 6 before tilting is indicated by a two-dot dashed line, and reference 40 indicates a support shaft which supports the fan guiding duct component 6 to be tiltable. The tilt angle S1 of the fan guiding duct component 6 is an angle formed between the lower surface of the fan guiding duct component 6 before tilting and the lower surface of the fan guiding duct component 6 after tilting.

For example, the tilt angle varying mechanism 9 is provided in the paper feed cassette 2. The tilt angle varying mechanism 9 includes a power transmission mechanism that transmits a driving force of a motor (not illustrated) to the support shaft 40 of the fan guiding duct component 6. For example, the power transmission mechanism includes mechanical elements such as gears, cams, and link mechanisms.

The sensor 10 will be described.

As illustrated in FIG. 7, the sensor 10 is incorporated in the fan guiding duct component 6. The sensor 10 may be provided in, for example, each of the first fan guiding duct component 6A and the second fan guiding duct component 6B. The sensor 10 can detect a temperature and humidity of the uppermost sheet of paper 21. For example, the sensor 10 may be a non-contact type temperature and humidity sensor. The sensor 10 detects a temperature and humidity of the uppermost sheet of paper 21 from the lower surface side of the fan guiding duct component 6. A detection result of the sensor 10 is sent to the system control unit 50.

The system control unit 50 will be described.

As illustrated in FIG. 7, the system control unit 50 generally controls each element of the paper feeding device 1. The system control unit 50 includes a drive controller 51, an air flow rate controller 52, and a tilt angle controller 53.

The drive controller 51 will be described.

The drive controller 51 controls driving of the fan 5 to start the fan 5 at the start of printing and stop the fan 5 at the end of the printing.

The drive controller 51 starts the fan 5, for example, when a print button is pressed. For example, the print button may be provided on a control panel unit 93 (see FIG. 2). The drive controller 51 stops the fan 5, for example, at the end of one job. Here, the job means one unit of printing. For example, when printing of a plurality of sheets are collectively performed in one job, the printing of the plurality of sheets is one printing.

The air flow rate controller 52 will be described.

The air flow rate controller 52 controls an air flow rate of the fan 5 on the basis of a detection result of the sensor 10.

For example, when a humidity of the uppermost sheet of paper 21 is higher than a preset threshold value (hereinafter referred to as a "humidity threshold value"), the air flow rate controller 52 may increase the air flow rate of the fan 5 so that an air flow rate flowing between the upper surface 21*a* of the uppermost sheet of paper 21 and the fan guiding duct component 6 increases. When the humidity of the uppermost sheet of paper 21 is lower than the humidity threshold value, the air flow rate controller 52 decreases the air flow rate of the fan 5 so that the air flow rate flowing between the upper surface 21*a* of the uppermost sheet of paper 21 and the fan guiding duct component 6 decreases.

For example, when a temperature of the uppermost sheet of paper 21 is lower than a preset threshold value (hereinafter referred to as a "temperature threshold value"), the air flow rate controller 52 may increase the air flow rate of the fan 5 so that the air flow rate flowing between the upper surface 21*a* of the uppermost sheet of paper 21 and the fan guiding duct component 6 increases. When the temperature of the uppermost sheet of paper 21 is higher than the temperature threshold value, the air flow rate controller 52 decreases the air flow rate of the fan 5 so that the air flow rate flowing between the upper surface 21*a* of the uppermost sheet of paper 21 and the fan guiding duct component 6 decreases.

The air flow rate controller 52 may control the air flow rate of the fan 5 on the basis of detection results of the paper position detection unit 8 and the tray-side sensor 33. The air flow rate controller 52 calculates a weight of the uppermost sheet of paper 21 on the basis of the detection results of the cassette-side paper position detection unit 8A and the airfoil-side paper position detection unit 8B, and the detection result of the tray-side sensor 33. The air flow rate controller 52 controls the air flow rate of the fan 5 on the basis of the weight of the uppermost sheet of paper 21. For example, when a weight of the uppermost sheet of paper 21 is larger than a preset threshold value (hereinafter, referred to as a "weight threshold value"), the air flow rate controller 52 may increase the air flow rate of the fan 5 so that the air flow rate flowing between the upper surface 21*a* of the uppermost sheet of paper 21 and the fan guiding duct component 6 increases. When a weight of the uppermost sheet of paper 21 is smaller than the weight threshold value, the air flow rate controller 52 decreases the air flow rate of the fan 5 so that the air flow rate flowing between the upper surface 21*a* of the uppermost sheet of paper 21 and the fan guiding duct component 6 decreases.

The tilt angle controller 53 will be described.

The tilt angle controller 53 controls the tilt angle varying mechanism 9 on the basis of a detection result of the paper position detection unit 8. The tilt angle controller 53 controls the tilt angle varying mechanism 9 on the basis of the detection results of the cassette-side paper position detection unit 8A and the airfoil-side paper position detection unit 8B.

For example, the tilt angle controller 53 controls the tilt angle varying mechanism 9 so that the upper surface 21*a* of the uppermost sheet of paper 21 and the lower surface of the fan guiding duct component 6 are made substantially parallel to each other (see FIG. 8).

An example of an operation of the paper feeding device 1 will be described.

First, the paper bundle 20 is accommodated in the paper feed cassette 2. The paper bundle 20 placed on the paper feed cassette 2 is aligned by the alignment component 4. When the pair of lateral alignment components 4A and 4B are in contact with the paper bundle 20 from an outward side in the paper width direction, the paper bundle 20 is positioned in the paper width direction. When the longitudinal alignment component 4C is in contact with the paper bundle 20 from an outward side in the paper conveying direction K1, the paper bundle 20 is positioned in the paper conveying direction K1.

Next, the paper feed cassette 2 in which the paper bundle 20 is accommodated is inserted into the paper accommodating unit 94 (for example, a lowermost stage) of the image forming device 90.

Then, a height of the paper bundle 20 (position of the uppermost sheet of paper 21) is detected by the paper position detection unit 8. A detection result of the paper position detection unit 8 is sent to the system control unit 50.

The system control unit 50 controls the tilting tray 7 so that the paper bundle 20 is tilted. Due to the tilting of the tilting tray 7, an upstream end of the uppermost sheet of paper 21 in the paper conveying direction K1 is positioned as a lower part, and a downstream end of the uppermost sheet of paper 21 in the paper conveying direction K1 is positioned as an upper part.

Next, the pickup roller 3 is lowered. The pickup roller 3 comes into contact with the upper surface 21*a* of the paper bundle 20 placed on the paper feed cassette 2. Thereby, a preparation for conveying the paper in the paper feed cassette 2 is completed (standby state).

When the print button is pressed in the standby state, the drive controller 51 starts the fan 5. The fan 5 generates airflow due to driving of the fan 5. The alignment component 4 guides the airflow generated by the fan 5 through the airflow passage 4*i* and then from the air blowout port 4*h* toward the upper surface 21*a* of the uppermost sheet of paper 21.

The fan guiding duct component 6 causes the uppermost sheet of paper 21 to rise up by generating a negative pressure between the fan guiding duct component 6 and the uppermost sheet of paper 21 of the paper bundle 20 using the airflow coming out of the air blowout port 4*h* (airflow from the fan 5).

Thereby, the uppermost sheet of paper 21 is separated from the paper bundle 20 placed on the paper feed cassette 2.

When the pickup roller 3 rotates in a state in which the uppermost sheet of paper 21 is separated from the paper bundle 20 placed on the paper feed cassette 2, the uppermost sheet of paper 21 is fed out of the paper feed cassette 2.

At the end of one job, the drive controller 51 stops the fan 5. Thereby, the operation of the paper feeding device 1 is completed.

According to the embodiment, the paper feeding device 1 includes the paper feed cassette 2, the alignment component 4, the fan 5, and the fan guiding duct component 6. The paper bundle 20 in which a plurality of sheets of paper are stacked can be placed on the paper feed cassette 2. The alignment component 4 can align the paper bundle 20 placed on the paper feed cassette 2. The fan 5 is connected to the alignment component 4. The fan 5 can generate airflow. The fan guiding duct component 6 is connected to the alignment component 4. The fan guiding duct component 6 is positioned above the paper bundle 20 placed on the paper feed cassette 2. The fan guiding duct component 6 generates a negative pressure between the fan guiding duct component 6 and the uppermost sheet of paper 21 of the paper bundle 20 due to the airflow from the fan 5. With the above configuration, the following effects are achieved.

The fan guiding duct component 6 can cause the uppermost sheet of paper 21 to rise up by generating a negative pressure between the fan guiding duct component 6 and the uppermost sheet of paper 21 in the paper bundle 20 using the airflow from the fan 5. Accordingly, it is possible to provide the paper feeding device 1 capable of separating the uppermost sheet of paper 21 from the paper bundle 20 placed on the paper feed cassette 2.

In addition, since an influence of friction, contact, or the like can be reduced between sheets of paper, one sheet of paper can easily be taken out at a time. In addition, since a complicated structure such as a shutter mechanism is not required, the paper feeding device 1 can be simplified. In addition, since a large-sized fan for generating a large air flow rate is not required, a size of the fan 5 can be reduced. In addition, noise reduction can be achieved by reducing the output of the fan 5 (rotation speed of a motor of the fan 5). In addition, excessive rising-up of the uppermost sheet of paper 21 can be inhibited by the fan guiding duct component 6. In addition, when the paper feeding device 1 is mounted on each level of the paper accommodating unit 94 of the image forming device 90, the uppermost sheet of paper 21 can be separated from the paper bundle 20 placed on each level.

Also, when the alignment component 4 includes the air blowout port 4*h* which opens so that airflow from the fan 5 flows toward a space between the upper surface 21*a* of the uppermost sheet of paper 21 and the lower surface of the fan guiding duct component 6, the following effects are achieved.

A negative pressure is easily generated between the upper surface 21*a* of the uppermost sheet of paper 21 and the lower surface of the fan guiding duct component 6 compared to a case in which the air blowout port 4*h* opens toward a side surface of the paper bundle 20, and thereby the uppermost sheet of paper 21 is easily separated from the paper bundle 20 placed on the paper feed cassette 2.

Also, when a plurality of fan guiding duct components 6 are disposed above the paper bundle 20 placed on the paper feed cassette 2, the following effects are achieved.

The uppermost sheet of paper 21 is caused to easily rise up in a wide range compared to a case in which only one fan guiding duct component 6 is disposed.

Further, a plurality of alignment components 4 are provided. The plurality of alignment components 4 include a pair of lateral alignment components 4 disposed at a distance from each other in the paper width direction. The plurality of fan guiding duct components 6 include the lateral fan guiding duct components 6A and 6B connected to the pair of lateral alignment components 4. With the above configuration, the following effects are achieved.

The uppermost sheet of paper 21 is caused to easily rise up with uniformity as a whole compared to a case in which the plurality of fan guiding duct components 6 are disposed only on one side of the lateral alignment components 4.

Also, when the tilting tray 7 which tilts the paper bundle 20 so that an upstream end of the uppermost sheet of paper 21 in the paper conveying direction K1 is positioned as a lower part and a downstream end of the uppermost sheet of paper 21 in the paper conveying direction K1 is positioned as an upper part is further provided, the following effects are achieved.

When the paper feeding device 1 is mounted on a lowermost level of the paper accommodating unit 94 of the image forming device 90, it is suitable for sending the uppermost sheet of paper 21 to the next process.

Also, when the tilt angle varying mechanism 9 that can change a tilt angle of the fan guiding duct component 6 so that an upstream end of the fan guiding duct component 6 in the paper conveying direction K1 is positioned as a lower part and a downstream end of the fan guiding duct component 6 in the paper conveying direction K1 is positioned as an upper part is further provided, the following effects are achieved.

Even when the uppermost sheet of paper 21 is tilted, since it is possible to change a tilt angle of the fan guiding duct component 6, the uppermost sheet of paper 21 is easily separated from the paper bundle 20 placed on the paper feed cassette 2.

Also, when the paper position detection unit 8 capable of detecting a position of the uppermost sheet of paper 21, and the tilt angle controller 53 which controls the tilt angle varying mechanism 9 on the basis of a detection result of the paper position detection unit 8 are further provided, the following effects are achieved.

Since a tilt angle of the fan guiding duct component 6 can be changed in accordance with a tilt of the uppermost sheet of paper 21, the uppermost sheet of paper 21 is easily separated from the paper bundle 20 placed on the paper feed cassette 2.

Also, when the tilt angle controller 53 controls the tilt angle varying mechanism 9 so that the upper surface 21*a* of the uppermost sheet of paper 21 and the lower surface of the fan guiding duct component 6 are made parallel to each other, the following effects are achieved.

Since a negative pressure is easily generated with uniformity between the upper surface 21*a* of the uppermost sheet of paper 21 and the lower surface of the fan guiding duct component 6 compared to a case in which the upper surface 21*a* of the uppermost sheet of paper 21 intersects the lower surface of the fan guiding duct component 6, the uppermost sheet of paper 21 is caused to easily rise up with uniformity.

Also, when the drive controller 51 which controls driving of the fan 5 to start the fan 5 at the start of printing and stop the fan 5 at the end of the printing is further provided, the following effects are achieved.

Power consumption can be reduced compared to a case in which the fan 5 is constantly driven.

Also, when the sensor 10 capable of detecting a temperature and humidity of the uppermost sheet of paper 21 and the air flow rate controller 52 which controls an air flow rate of the fan 5 on the basis of a detection result of the sensor 10 are further provided, the following effects are achieved.

A temperature and humidity of the uppermost sheet of paper 21 can be ascertained by the sensor 10. In addition, since the air flow rate of the fan 5 can be controlled in accordance with the temperature and humidity of the uppermost sheet of paper 21, the uppermost sheet of paper 21 can be stably separated from the paper bundle 20 placed on the paper feed cassette 2.

In addition, when the sensor 10 is incorporated in the fan guiding duct component 6, the following effects are achieved. It is possible to secure rectifying action of airflow by the fan guiding duct component 6 compared to a case in which the sensor 10 is externally attached to the fan guiding duct component 6.

Also, when the air flow rate controller 52 controls an air flow rate of the fan 5 on the basis of detection results of the paper position detection unit 8 and the tray-side sensor 33, the following effects are achieved.

Since the air flow rate of the fan 5 can be controlled in accordance with a weight of the uppermost sheet of paper 21, the uppermost sheet of paper 21 can be stably separated from the paper bundle 20 placed on the paper feed cassette 2.

Also, when the fan guiding duct component 6 has an airfoil shape, the following effects are achieved.

A high negative pressure (that is, low pressure) can easily be generated between the fan guiding duct component 6 and the uppermost sheet of paper 21 compared to a case in which the fan guiding duct component 6 has a flat plate shape. Therefore, the uppermost sheet of paper 21 can easily be separated from the paper bundle 20 placed on the paper feed cassette 2.

Hereinafter, modified examples of the embodiment will be described.

A first modified example of the embodiment will be described.

In the embodiment, the case in which the fan 5 is fixed to the alignment component 4 has been described, but the present embodiment is not limited to the example described above.

Figure 9:
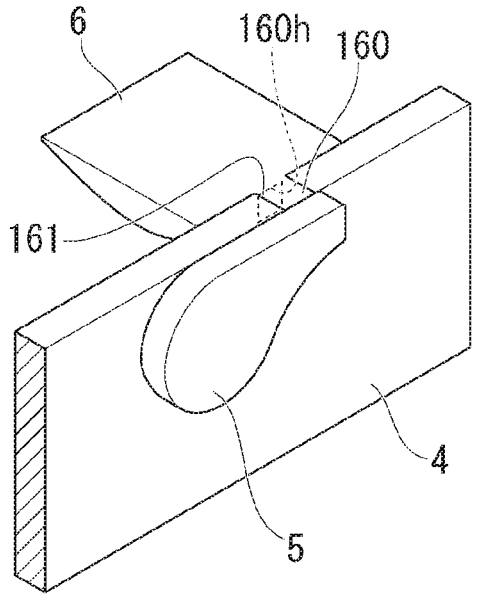
FIG. 9 is a perspective view illustrating a fan guiding duct component of a first modified example of the embodiment.
Figure 10:
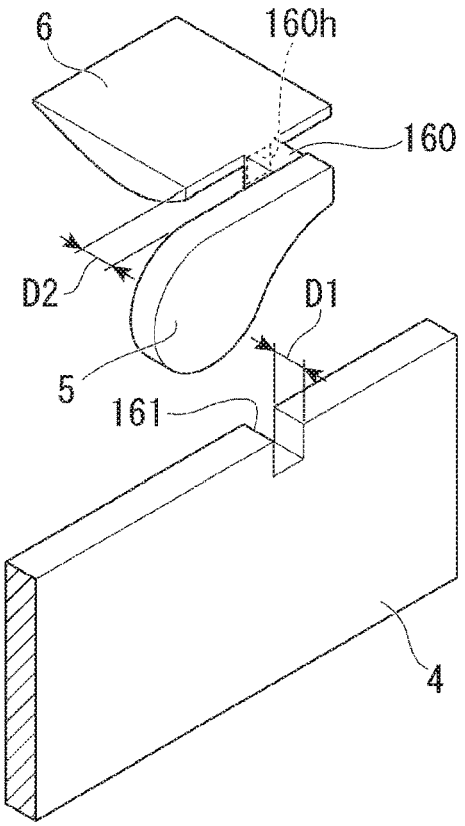
FIG. 10 is a perspective view illustrating a detached state of the fan guiding duct component of the first modified example of the embodiment.

FIG. 9 is a perspective view illustrating the fan guiding duct component 6 of the first modified example of the embodiment. FIG. 10 is a perspective view illustrating a detached state of the fan guiding duct component 6 according to the first modified example of the embodiment. In FIGS. 9 and 10, illustration of the paper feed cassette 2 or the like is omitted.

As illustrated in FIG. 9, the paper feeding device may further include a connecting member 160 that connects the fan 5 and the fan guiding duct component 6. The alignment component 4 may include an engaging recess 161 for detachably engaging the connecting member 160.

The connecting member 160 has a rectangular cylindrical shape. The connecting member 160 includes an air blowout port 160*h* that opens so that airflow from the fan 5 flows toward a space between the upper surface 21*a* of the uppermost sheet of paper 21 (see FIG. 1) and the lower surface of the fan guiding duct component 6. An internal space of the connecting member 160 functions as an airflow passage for guiding the airflow from the fan 5. The engaging recess 161 has substantially the same size as an outer shape of the connecting member 160. As illustrated in FIG. 10, a width D1 of the engaging recess 161 (width of the alignment component 4) is substantially the same as a gap D2 between the fan 5 and the fan guiding duct component 6 (D1≈D2).

According to the first modified example, when the connecting member 160 for connecting the fan 5 and the fan guiding duct component 6 is further provided, and the alignment component 4 includes the engaging recess 161 for detachably engaging the connecting member 160, the following effects are achieved.

The fan 5 and the fan guiding duct component 6 can be integrated as a rectification unit (module). When the rectification unit is attached to the alignment component 4, a negative pressure is generated between the upper surface 21*a* of the uppermost sheet of paper 21 and the lower surface of the fan guiding duct component 6, and thereby the uppermost sheet of paper 21 can be caused to rise up.

When the rectification unit is removed from the alignment component 4, since there is no obstacle to the paper bundle 20, the paper bundle 20 can easily be placed on the paper feed cassette 2.

A second modified example of the embodiment will be described.

In the embodiment, the case in which the alignment component 4 includes only one air blowout port 4*h* which opens so that airflow from the fan 5 flows toward a space between the upper surface 21*a* of the uppermost sheet of paper 21 and the lower surface of the fan guiding duct component 6 has been described, but the present embodiment is not limited to the example described above.

Figure 11:
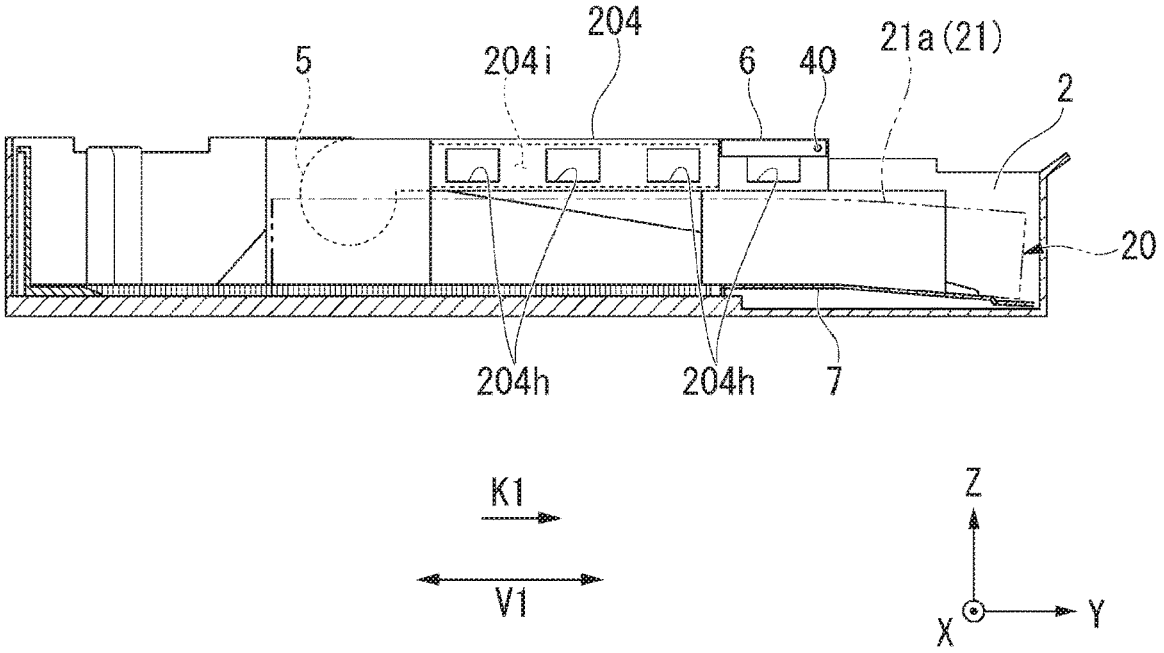
FIG. 11 is a view illustrating an alignment component of a second modified example of the embodiment.

FIG. 11 is a view illustrating an alignment component 204 of the second modified example of the embodiment. FIG. 11 corresponds to FIG. 4. Reference 204*i* in the drawing indicates an airflow passage for guiding the airflow from the fan 5.

As illustrated in FIG. 11, the alignment component 204 may have a plurality of air blowout ports 204*h* that open so that airflow from the airflow passage 204*i* is dispersed and goes out toward the upper surface 21*a* of the uppermost sheet of paper 21.

The plurality of air blowout ports 204*h* are disposed at intervals in a direction in which the alignment component 204 extends (the first direction V1). The air blowout ports 204*h* each have a rectangular shape having a longitudinal dimension in the direction in which the alignment component 204 extends.

According to the second modified example, when the alignment component 204 includes the airflow passage 204*i* which guides the airflow from the fan 5 and the plurality of air blowout ports 204*h* that open so that the airflow from the airflow passage 204*i* is dispersed and goes out toward the upper surface 21*a* of the uppermost sheet of paper 21, the following effects are achieved.

A negative pressure can be generated in a space above the uppermost sheet of paper 21 by the airflow coming out of the plurality of air blowout ports 204*h*. Therefore, a negative pressure can be generated in a wide range of the space above the uppermost sheet of paper 21 compared to a case in which the alignment component 4 has only one air blowout port 4*h*. Therefore, the uppermost sheet of paper 21 is easily separated from the paper bundle 20 placed on the paper feed cassette 2. For example, even when a paper size is larger (for example, A3 size or more) than a preset threshold value (hereinafter referred to as "size threshold value"), the uppermost sheet of paper 21 can be stably separated.

A third modified example of the embodiment will be described.

In the embodiment, the case in which the plurality of fan guiding duct components 6 are the lateral fan guiding duct components 6A and 6B connected to the pair of lateral alignment components 4A and 4B has been described, but the present embodiment is not limited to the example described above.

Figure 12:
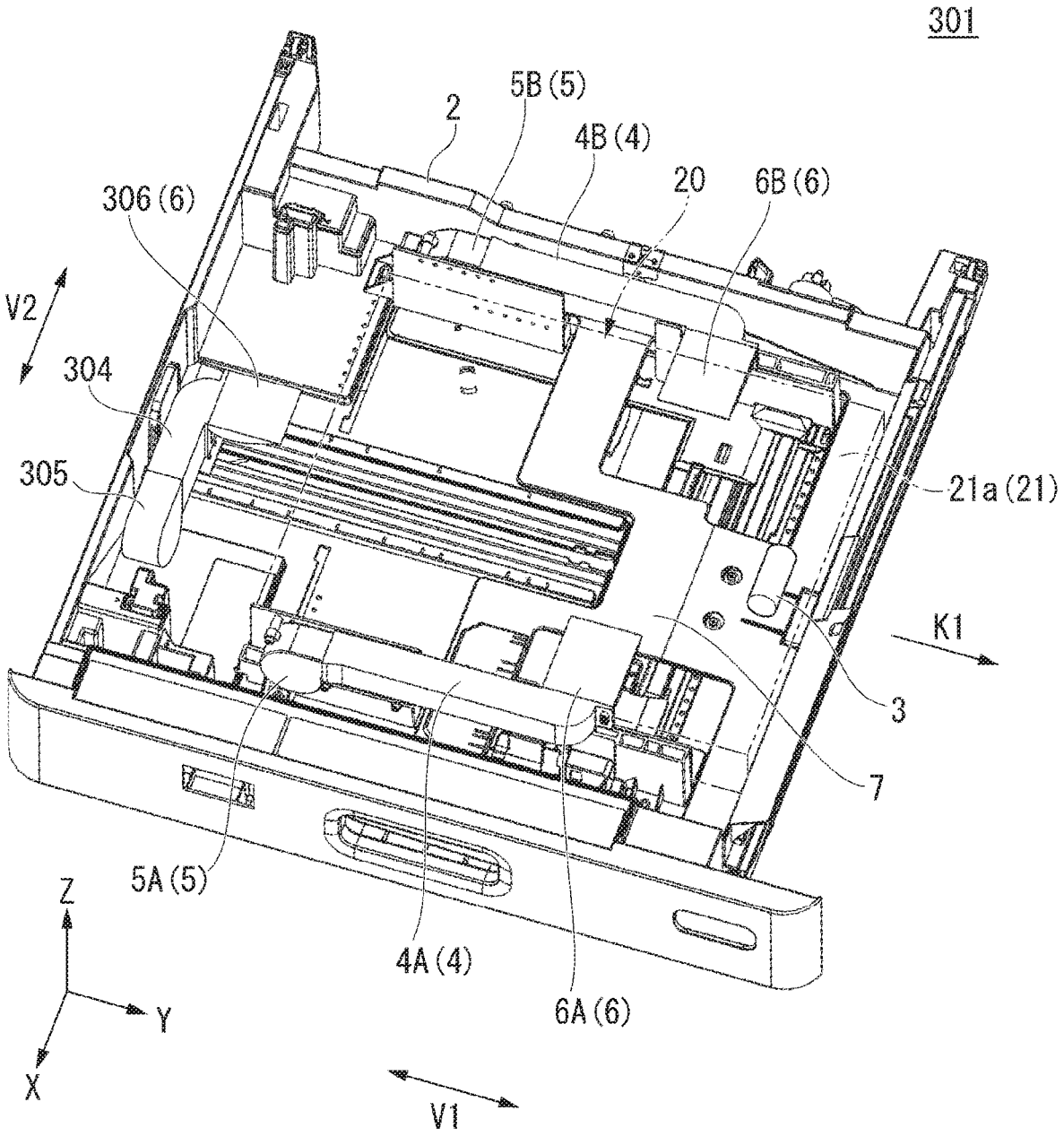
FIG. 12 is a perspective view illustrating a paper feeding device of a third modified example of the embodiment.

FIG. 12 is a perspective view illustrating a paper feeding device 301 of the third modified example of the embodiment. Reference 304 in the drawing denotes a longitudinal alignment component disposed at a position upstream of the paper bundle 20 in the paper conveying direction K1.

As illustrated in FIG. 12, the plurality of fan guiding duct components 6 may further include a longitudinal fan guiding duct component 306 connected to the longitudinal alignment component 304. The longitudinal alignment component 304 extends in the second direction V2. Reference 305 in the drawing denotes a fan (third fan) connected to a front end portion of the longitudinal alignment component 304.

According to the third modified example, when the plurality of alignment components 4 further include the longitudinal alignment component 304 disposed at a position upstream of the paper bundle 20 in the paper conveying direction K1, and the plurality of fan guiding duct components 6 further include the longitudinal fan guiding duct component 306 connected to the longitudinal alignment component 304, the following effects are achieved.

The uppermost sheet of paper 21 is caused to easily rise up with uniformity as a whole compared to a case in which the plurality of fan guiding duct components 6 are disposed only on the lateral alignment component 4.

A fourth modified example of the embodiment will be described.

In the embodiment, the case in which the tilt angle controller 53 that controls the tilt angle varying mechanism 9 on the basis of a detection result of the paper position detection unit 8 is provided has been described, but the present embodiment is not limited to the example described above.

Figure 13:
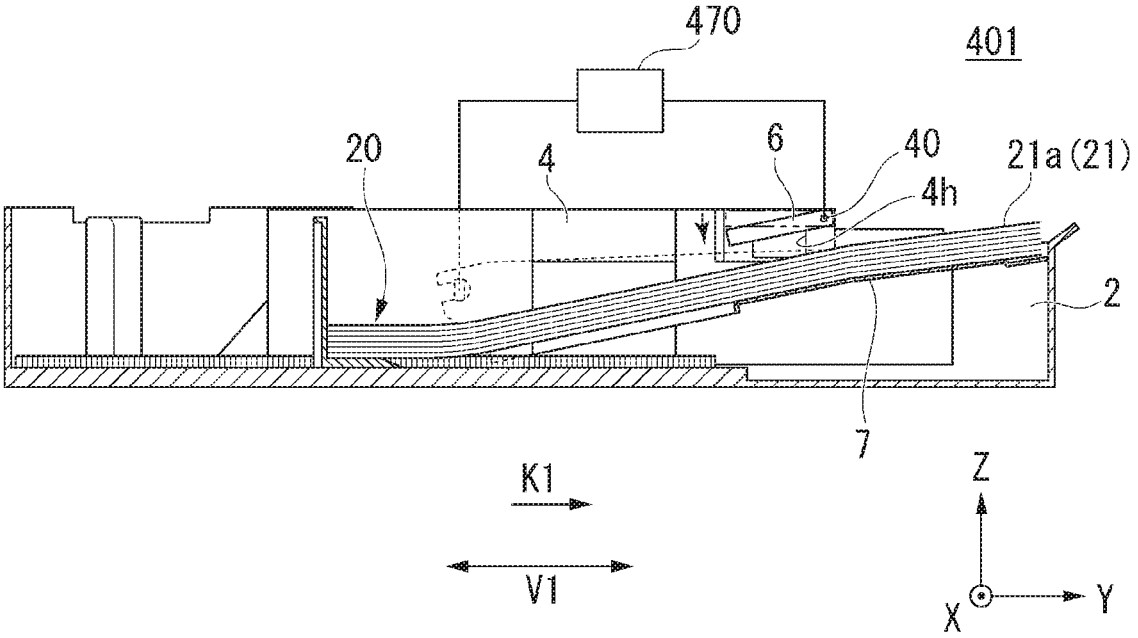
FIG. 13 is a view illustrating a paper feeding device of a fourth modified example of the embodiment.

FIG. 13 is a view illustrating a paper feeding device 401 of a fourth modified example of the embodiment. FIG. 13 corresponds to FIG. 4.

As illustrated in FIG. 13, the paper feeding device 401 may further include an interlocking mechanism 470 that tilts the fan guiding duct component 6 in conjunction with an operation of the tilting tray 7. For example, the interlocking mechanism 470 is a power transmission mechanism that transmits tilting of the tilting tray 7 to the fan guiding duct component 6. For example, the power transmission mechanism includes mechanical elements such as gears, cams, and link mechanisms. The tilting tray 7 and the fan guiding duct component 6 tilt in synchronization with each other.

The interlocking mechanism 470 tilts the fan guiding duct component 6 so that the upper surface 21*a* of the uppermost sheet of paper 21 and the lower surface of the fan guiding duct component 6 are made substantially parallel to each other. In FIG. 13, a state of the fan guiding duct component 6 after tilting is indicated by a solid line, and a state of the fan guiding duct component 6 before tilting is indicated by a two-dot dashed line.

According to the fourth modified example, when the interlocking mechanism 470 that tilts the fan guiding duct component 6 in conjunction with an operation of the tilting tray 7 is further provided, the following effects are achieved.

Since a tilt angle of the fan guiding duct component 6 can be changed in accordance with a tilt of the uppermost sheet of paper 21, the uppermost sheet of paper 21 is easily separated from the paper bundle 20 placed on the paper feed cassette 2. In addition, it is preferable in terms of not requiring electric power compared to a case in which the tilt angle varying mechanism 9 is electrically controlled.

Also, when the interlocking mechanism 470 tilts the fan guiding duct component 6 so that the upper surface 21*a* of the uppermost sheet of paper 21 and the lower surface of the fan guiding duct component 6 are made parallel to each other, the following effects are achieved.

Since a negative pressure is easily generated with uniformity between the upper surface 21*a* of the uppermost sheet of paper 21 and the lower surface of the fan guiding duct component 6 compared to a case in which the upper surface 21*a* of the uppermost sheet of paper 21 intersects the lower surface of the fan guiding duct component 6, the uppermost sheet of paper 21 is caused to easily rise up with uniformity.

A fifth modified example of the embodiment will be described.

In the embodiment, the case in which the tilt angle controller 53 that controls the tilt angle varying mechanism 9 on the basis of a detection result of the paper position detection unit 8 is provided has been described, but the present embodiment is not limited to the example described above.

Figure 14:
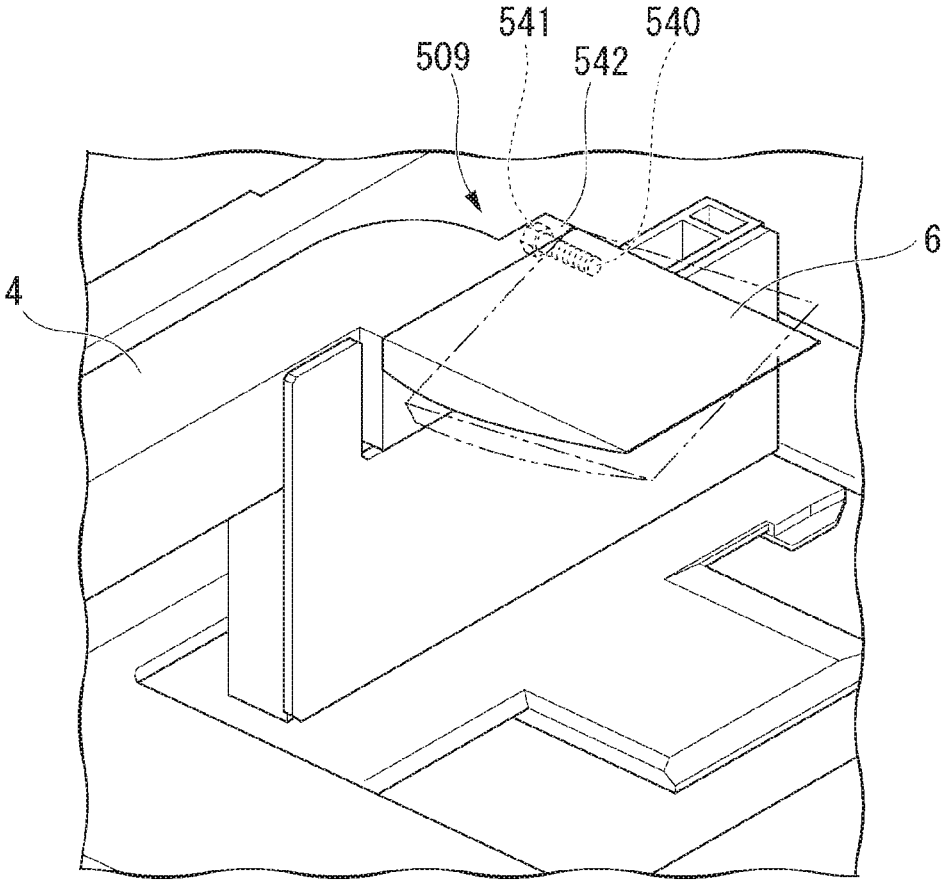
FIG. 14 is a perspective view illustrating a tilt angle varying mechanism of a fifth modified example of the embodiment.

FIG. 14 is a perspective view illustrating a tilt angle varying mechanism 509 of the fifth modified example of the embodiment.

As illustrated in FIG. 14, the tilt angle varying mechanism 509 may include a support shaft 540 which supports the fan guiding duct component 6 to be tiltable, and a tilt restriction part 541 which restricts tilting of the fan guiding duct component 6.

For example, the support shaft 540 is a shaft part (male screw part) of a bolt. For example, the tilt restriction part 541 is a head part of the bolt. For example, a female screw part to which the male screw part of the bolt can be screwed is formed in the fan guiding duct component 6. Reference 542 in the drawing indicates a support wall that forms a bearing surface of the head of the bolt. For example, an insertion hole through which the male screw part of the bolt can be inserted is formed in the support wall 542.

For example, when the bolt is loosened, tilting of the fan guiding duct component 6 is allowed. For example, when the bolt is fastened and fixed, tilting of the fan guiding duct component 6 is restricted. In FIG. 14, a state of the fan guiding duct component 6 before tilting is indicated by a solid line, and a state of the fan guiding duct component 6 after tilting is indicated by a two-dot dashed line.

According to the fifth modified example, when the tilt angle varying mechanism 509 includes the support shaft 540 which supports the fan guiding duct component 6 to be tiltable, and the tilt restriction part 541 which restricts tilting of the fan guiding duct component 6, the following effects are achieved.

A tilt angle of the fan guiding duct component 6 can be changed manually. For example, a tilt angle of the fan guiding duct component 6 can be changed in advance before printing. Therefore, the uppermost sheet of paper 21 is easily separated from the paper bundle 20 placed on the paper feed cassette 2 compared to a case in which a tilt angle of the fan guiding duct component 6 is set to be always constant. In addition, it is preferable in terms of not requiring electric power compared to a case in which the tilt angle varying mechanism is electrically controlled.

A sixth modified example of the embodiment will be described.

Figure 15:
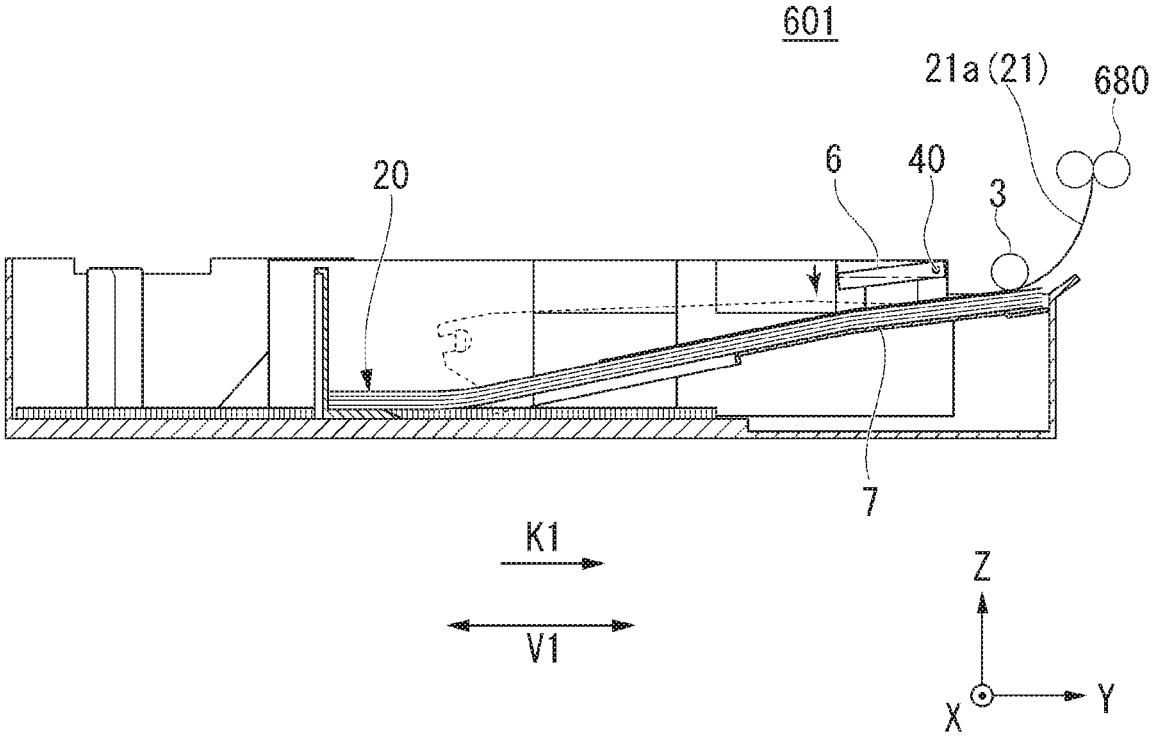
FIG. 15 is a view illustrating a paper feeding device of a sixth modified example of the embodiment.

FIG. 15 is a view illustrating a paper feeding device 601 of the sixth modified example of the embodiment. FIG. 15 corresponds to FIG. 4. Reference 3 in the drawing denotes the pickup roller 3 that feeds out the uppermost sheet of paper 21 to a downstream side in the paper conveying direction K1.

As illustrated in FIG. 15, the paper feeding device 601 may further include a stopper 680 that temporarily stops the uppermost sheet of paper 21 fed out by the pickup roller 3 in a state in which an upstream end of the uppermost sheet of paper 21 in the paper conveying direction K1 is positioned as a lower part and a downstream end of the uppermost sheet of paper 21 in the paper conveying direction K1 is positioned as an upper part.

For example, the stopper 680 is a pair of rollers (separation rollers) positioned downstream of the pickup roller 3 in the paper conveying direction K1. The fan guiding duct component 6 is positioned above a center position in the paper conveying direction K1 of the uppermost sheet of paper 21 in a stopped state due to the stopper 680. The uppermost sheet of paper 21 in a stopped state due to the stopper 680 follows an arcuate shape that is convex downward.

In FIG. 15, a state of the fan guiding duct component 6 after tilting is indicated by a solid line, and a state of the fan guiding duct component 6 before tilting is indicated by a two-dot dashed line.

According to the sixth modified example, the stopper 680 that temporarily stops the uppermost sheet of paper 21 fed out by the pickup roller 3 in a state in which an upstream end of the uppermost sheet of paper 21 in the paper conveying direction K1 is positioned as a lower part and a downstream end of the uppermost sheet of paper 21 in the paper conveying direction K1 is positioned as an upper part is further provided. When the fan guiding duct component 6 is positioned above a center position in the paper conveying direction K1 of the uppermost sheet of paper 21 in a stopped state due to the stopper 680, the following effects are achieved.

A negative pressure is easily generated in a space above the center position of the uppermost sheet of paper 21 in a stopped state due to the stopper 680 compared to a case in which the fan guiding duct component 6 is disposed offset from the center position in the paper conveying direction of the uppermost sheet of paper 21 in a stopped state due to the stopper 680. Therefore, the uppermost sheet of paper 21 is caused to easily rise up even when the uppermost sheet of paper 21 in a stopped state due to the stopper 680 follows an arcuate shape that is convex downward.

A seventh modified example of the embodiment will be described.

In the embodiment, the case in which the tilt angle varying mechanism 9 capable of changing the tilt angle S1 of the fan guiding duct component 6 is provided has been described, but the present embodiment is not limited to the example described above. For example, the paper feeding device may not have the tilt angle varying mechanism 9.

Figure 16:
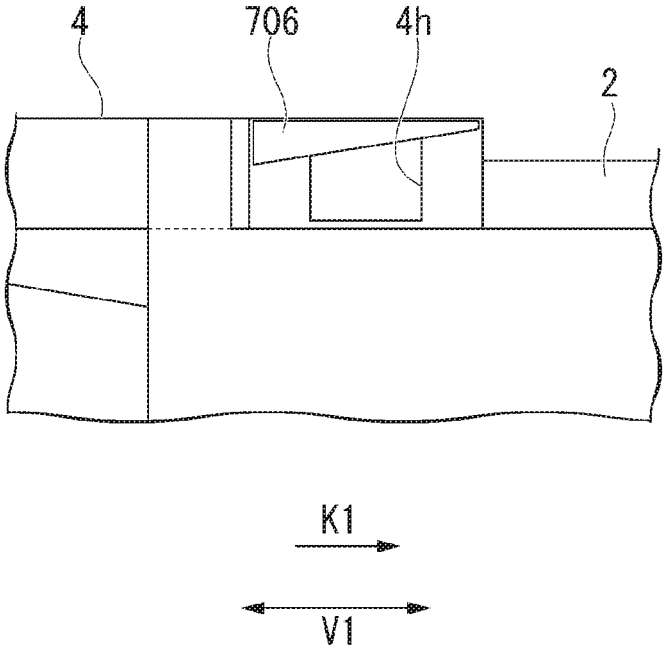
FIG. 16 is a view illustrating a fan guiding duct component of a seventh modified example of the embodiment.

FIG. 16 is a view illustrating a fan guiding duct component 706 of the seventh modified example of the embodiment.

As illustrated in FIG. 16, a lower surface of the fan guiding duct component 706 may be tilted so that an upstream end of the lower surface of the fan guiding duct component 706 in the paper conveying direction K1 is positioned as a lower part and a downstream end of the lower surface of the fan guiding duct component 706 in the paper conveying direction K1 is positioned as an upper part. The fan guiding duct component 706 is fixed to the alignment component 4.

According to the seventh modified example, when the lower surface of the fan guiding duct component 706 is tilted so that an upstream end of the lower surface of the fan guiding duct component 706 in the paper conveying direction K1 is positioned as a lower part and a downstream end of the lower surface of the fan guiding duct component 706 in the paper conveying direction K1 is positioned as an upper part, the following effects are achieved.

The uppermost sheet of paper 21 is easily separated from the paper bundle 20 placed on the paper feed cassette 2 compared to a case in which the lower surface of the fan guiding duct component 706 is always set horizontally. In addition, it is preferable in terms of not requiring electric power compared to a case in which the tilt angle varying mechanism 9 is electrically controlled.

An eighth modified example of the embodiment will be described.

Figure 17:
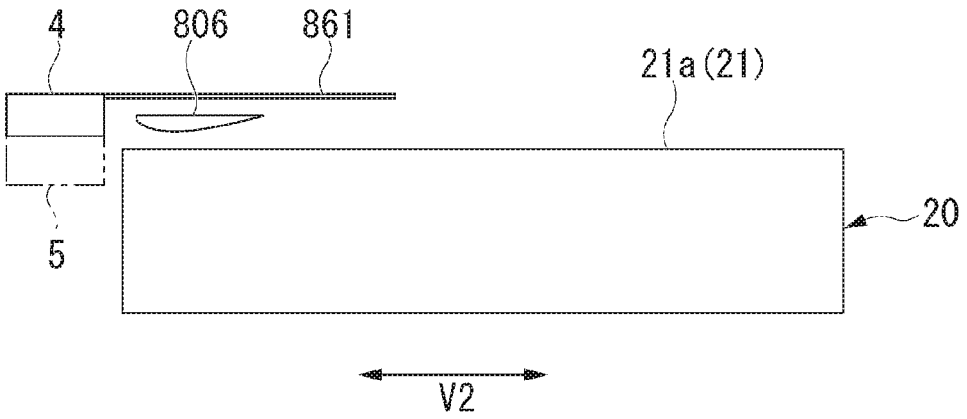
FIG. 17 is a view illustrating a fan guiding duct component of an eighth modified example of the embodiment.

FIG. 17 is a view illustrating a fan guiding duct component 806 according to the eighth modified example of the embodiment.

As illustrated in FIG. 17, a flow path covering part 861 may be provided above the fan guiding duct component 806. For example, the flow path covering part 861 may have a rectangular plate shape substantially parallel to a horizontal plane. The flow path covering part 861 covers the fan guiding duct component 806 from above so that a flow path for airflow from the fan 5 is formed between an upper surface of the fan guiding duct component 806 and a lower surface of the flow path covering part 861. For example, a space between the upper surface of the fan guiding duct component 806 and the lower surface of the flow path covering part 861 opens in the first direction V1 (see FIG. 1).

According to the eighth modified example, when the flow path covering part 861 which covers the fan guiding duct component 806 from above so that a flow path for the airflow from the fan 5 is formed between the upper surface of the fan guiding duct component 806 and the lower surface of the flow path covering part 861 is provided above the fan guiding duct component 806, the following effects are achieved.

Flow paths for the airflow from the fan 5 can be formed above and below the fan guiding duct component 806. For example, a negative pressure in a space above the uppermost sheet of paper 21 can be adjusted by changing a distance between the upper and lower flow paths.

A ninth modified example of the embodiment will be described.

In the eighth modified example of the embodiment, the case in which the space between the upper surface of the fan guiding duct component 806 and the lower surface of the flow path covering part 861 opens in the first direction V1 has been described, but the present embodiment is not limited to the example described above.

Figure 18:
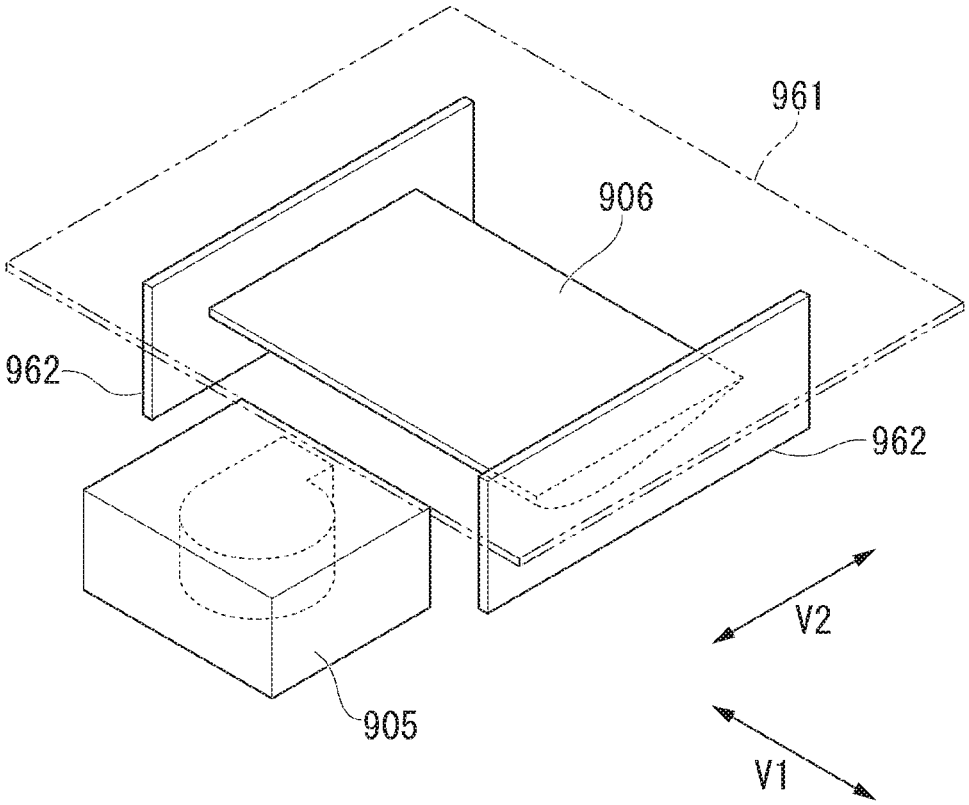
FIG. 18 is a perspective view illustrating a fan guiding duct component of a ninth modified example of the embodiment.

FIG. 18 is a perspective view illustrating a fan guiding duct component 906 of the ninth modified example of the embodiment.

As illustrated in FIG. 18, the fan guiding duct component 906 has a fixed length in the first direction V1. Blocking members 962 that block airflow from the fan 905 may be provided at both ends of the fan guiding duct component 906.

In a region in which the fan guiding duct component 906 is installed, the blocking members 962 restrict a flow of airflow so that the airflow passes between the upper surface 21*a* of the uppermost sheet of paper 21 (see FIG. 1) and the fan guiding duct component 906, and between the fan guiding duct component 906 and a flow path covering part 961. Each of the blocking members 962 has a plate shape parallel to a virtual plane (vertical plane) perpendicular to the first direction V1.

The fan 905, the flow path covering part 961, the pair of blocking members 962, and the fan guiding duct component 906 may be configured as an integrated module. The fan 905 is integrally connected to an outer end in the width direction of the flow path covering part 961. A lower surface of the flow path covering part 961 is integrally connected to upper edges of the pair of blocking members 962. Both ends of the fan guiding duct component 906 are integrally connected to inner surfaces of the pair of blocking members 962.

According to the ninth modified example, when the blocking members 962 that block airflow from the fan 905 are provided at both ends of the fan guiding duct component 906 in the first direction V1, the following effects are achieved. Since the airflow from the fan 905 can be blocked by the blocking members 962, the airflow from the fan 905 being introduced toward an unintended area can be inhibited. Therefore, the uppermost sheet of paper 21 can be stably separated from the paper bundle 20 placed on the paper feed cassette 2.

Also, when the fan 905, the flow path covering part 961, the pair of blocking members 962, and the fan guiding duct component 906 are configured as an integrated module, the following effects are achieved. When the integrated module is installed at an arbitrary position, the uppermost sheet of paper 21 at the arbitrary position can be separated.

In the above-described embodiment, the case in which the paper feeding device 1 is applied to the image forming device 90 such as a printer has been described, but the present embodiment is not limited to the example described above. For example, the paper feeding device 1 may be applied to an erasing device. For example, the paper feeding device 1 may be applied to financial instruments, postal sorting machines, printing machines, copying machines, facsimile machines, multi-function printers, or the like. Also, the multi-function printers may be for business use or office use and may be those including paper of various types.

In the above-described embodiment, the case in which the plurality of fan guiding duct components 6 are disposed above the paper bundle 20 and the plurality of fan guiding duct components 6 are connected to the respective alignment components 4 one by one has been described, but the present embodiment is not limited to the example described above. For example, the plurality of fan guiding duct components 6 may be connected to one of the alignment components 4. According to this configuration, airflow can be sent to respective spaces between the plurality of fan guiding duct components 6 and the uppermost sheet of paper 21. For example, even when a paper size is larger (for example, A3 size or more) than a preset threshold value (hereinafter referred to as "size threshold value"), the uppermost sheet of paper 21 can be stably separated.

In the above-described embodiment, the case in which the plurality of fan guiding duct components 6 are disposed above the paper bundle 20 has been described, but the present embodiment is not limited to the example described above. For example, only one fan guiding duct component 6 may be disposed above the paper bundle 20. For example, one fan guiding duct component 6 may be connected to any one of the alignment components 4.

In the above-described embodiment, the case in which the airfoil-side paper position detection unit 8B and the sensor 10 are incorporated in the fan guiding duct component 6 has been described, but the present embodiment is not limited to the example described above. For example, at least one of the airfoil-side paper position detection unit 8B and the sensor 10 may be externally attached to the fan guiding duct component 6. Alternatively, at least one of the airfoil-side paper position detection unit 8B and the sensor 10 may be supported by a member other than the fan guiding duct component 6 such as the paper feed cassette 2.

In the above-described embodiment, the case in which the sensor 10 can detect a temperature and humidity of the uppermost sheet of paper 21 has been described, but the present embodiment is not limited to the example described above. For example, the sensor 10 may be able to detect only a temperature of the uppermost sheet of paper 21. Alternatively, the sensor 10 may be able to detect only the humidity of the uppermost sheet of paper 21. That is, the sensor 10 only needs to be able to detect at least one of the temperature and humidity of the uppermost sheet of paper 21.

In the above-described embodiment, the case in which the system control unit 50 controls each element of the fan 5 and the tilt angle varying mechanism 9 has been described, but the present embodiment is not limited to the example described above. For example, at least one of the above-described elements may be manually operated.

According to at least one embodiment described above, it is possible to provide a paper feeding device 1 capable of separating the uppermost sheet of paper 21 from the paper bundle 20 placed on the paper feed cassette 2 by including the paper feed cassette 2 on which the paper bundle 20 in which a plurality of sheets of paper are stacked can be placed, the alignment component 4 capable of aligning the paper bundle 20 placed on the paper feed cassette 2, the fan 5 connected to the alignment component 4 and capable of generating airflow, and the fan guiding duct component 6 connected to the alignment component 4, positioned above the paper bundle 20 placed on the paper feed cassette 2, and configured to generate a negative pressure between the fan guiding duct component 6 and the uppermost sheet of paper 21 of the paper bundle 20 due to the airflow from the fan 5.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper feeding device comprising:

a paper feed cassette on which a paper bundle comprising a plurality of sheets of paper is able to be placed;

an alignment component which is able to align the paper bundle placed on the paper feed cassette;

a fan which is connected to the alignment component and able to generate airflow;

a fan guiding duct component connected to the alignment component, positioned above the paper bundle placed on the paper feed cassette, and configured to generate a negative pressure between the fan guiding duct component and an uppermost sheet of paper in the paper bundle due to the airflow from the fan; and a connecting member which connects the fan and the fan guiding duct component, wherein the alignment component includes an engaging recess to which the connecting member is detachably engaged, and the connecting member has a rectangular cylindrical shape, and includes an air blowout port that opens so that airflow from the fan flows toward a space between an upper surface of the uppermost sheet of paper and a lower surface of the fan guiding duct component.

2. The paper feeding device according to claim 1, wherein the alignment component includes an air blowout port which opens so that the airflow from the fan flows toward the space between the upper surface of the uppermost sheet of paper and the lower surface of the fan guiding duct component.

3. The paper feeding device according to claim 1, wherein the alignment component includes:

an airflow passage which guides airflow from the fan; and a plurality of air blowout ports which open so that the airflow from the fan that passes through the airflow passage is dispersed and goes out toward the upper surface of the uppermost sheet of paper.

4. The paper feeding device according to claim 1, wherein a plurality of fan guiding duct components, each of which is identical to the fan guiding duct component, are disposed above the paper bundle placed on the paper feed cassette.

5. The paper feeding device according to claim 4, wherein a plurality of alignment components, each of which is identical to the alignment component, are provided, the plurality of alignment components include a pair of lateral alignment components disposed at a distance from each other in a paper width direction, and the plurality of fan guiding duct components include lateral fan guiding duct components respectively connected to the pair of lateral alignment components.

6. The paper feeding device according to claim 5, wherein the plurality of alignment components further include a longitudinal alignment component disposed at a position upstream of the paper bundle in a paper conveying direction, and the plurality of fan guiding duct components further include a longitudinal fan guiding duct component connected to the longitudinal alignment component.

7. The paper feeding device according to claim 1, further comprising a tilting tray which tilts the paper bundle so that an upstream end of the uppermost sheet of paper in the paper conveying direction is positioned as a lower part, and a downstream end of the uppermost sheet of paper in the paper conveying direction is positioned as an upper part.

8. The paper feeding device according to claim 7, further comprising an interlocking mechanism which tilts the fan guiding duct component in conjunction with an operation of the tilting tray, wherein the interlocking mechanism is a power transmission mechanism that mechanically couples tilting of the tilting tray to tilting of the fan guiding duct component.

9. The paper feeding device according to claim 8, wherein the interlocking mechanism tilts the fan guiding duct component so that the upper surface of the uppermost sheet of paper and the lower surface of the fan guiding duct component are made parallel to each other.

10. The paper feeding device according to claim 1, further comprising a tilt angle varying mechanism which is able to change a tilt angle of the fan guiding duct component so that an upstream end of the fan guiding duct component in the paper conveying direction is positioned as a lower part and a downstream end of the fan guiding duct component in the paper conveying direction is positioned as an upper part, wherein the tilt angle varying mechanism includes a support shaft which supports the fan guiding duct component while permitting tilting of the fan guiding duct component.

11. The paper feeding device according to claim 10, wherein the tilt angle varying mechanism further includes a tilt restriction part which restricts tilting of the fan guiding duct component, wherein the support shaft is a shaft part of a bolt, wherein the tilt restriction part is a head part of the bolt.

12. The paper feeding device according to claim 10, further comprising:

a paper position detection unit which is able to detect a position of the uppermost sheet of paper; and a tilt angle controller which controls the tilt angle varying mechanism on the basis of a detection result of the paper position detection unit, wherein the paper position detection unit is a non-contact type displacement sensor.

13. The paper feeding device according to claim 12, wherein the tilt angle controller controls the tilt angle varying mechanism so that the upper surface of the uppermost sheet of paper and the lower surface of the fan guiding duct component are made parallel to each other.

14. The paper feeding device according to claim 1, further comprising:

a pickup roller which feeds out the uppermost sheet of paper toward a downstream side in the paper conveying direction; and a stopper which temporarily stops the uppermost sheet of paper fed out by the pickup roller in a state in which an upstream end of the uppermost sheet of paper in the paper conveying direction is positioned as a lower part and a downstream end of the uppermost sheet of paper in the paper conveying direction is positioned as an upper part, wherein the fan guiding duct component is positioned above a center position in the paper conveying direction of the uppermost sheet of paper in a stopped state due to the stopper, wherein the stopper is a pair of rollers positioned downstream of the pickup roller in the paper conveying direction.

15. The paper feeding device according to claim 1, further comprising:

a sensor which is able to detect at least one of a temperature and humidity of the uppermost sheet of paper; and an air flow rate controller which controls an air flow rate of the fan on the basis of a detection result of the sensor.

16. The paper feeding device according to claim 1, wherein the lower surface of the fan guiding duct component is tilted so that an upstream end of the lower surface of the fan guiding duct component in the paper conveying direction is positioned as a lower part and a downstream end of the lower surface of the fan guiding duct component in the paper conveying direction is positioned as an upper part.

17. The paper feeding device according to claim 1, wherein the fan guiding duct component has an airfoil shape.

18. The paper feeding device according to claim 1, wherein a blocking member which blocks airflow from the fan is provided at an end portion of the fan guiding duct component in the paper conveying direction, wherein the blocking member has a plate shape and a flat surface of the blocking member is parallel to a vertical plane.

19. An image processing apparatus comprising:

a paper feed cassette on which a paper bundle comprising a plurality of sheets of paper is able to be placed;

an alignment component which is able to align the paper bundle placed on the paper feed cassette;

a fan which is connected to the alignment component and able to generate airflow;

a fan guiding duct component connected to the alignment component, positioned above the paper bundle placed on the paper feed cassette, and configured to generate a negative pressure between the fan guiding duct component and an uppermost sheet of paper in the paper bundle due to the airflow from the fan; and a connecting member which connects the fan and the fan guiding duct component, wherein the alignment component includes an engaging recess to which the connecting member is detachably engaged, and the connecting member has a rectangular cylindrical shape, and includes an air blowout port that opens so that airflow from the fan flows toward a space between an upper surface of the uppermost sheet of paper and a lower surface of the fan guiding duct component.

* * * * *